US011148454B2

(12) United States Patent
Okamoto et al.

(10) Patent No.: US 11,148,454 B2
(45) Date of Patent: Oct. 19, 2021

(54) SHEET BUNDLE DISCHARGING APPARATUS AND BOOKBINDING APPARATUS

(71) Applicant: CANON FINETECH NISCA INC., Misato (JP)

(72) Inventors: Koji Okamoto, Tsukubamirai (JP); Keiichi Nagasawa, Minami-Alps (JP); Dai Matsubara, Moriya (JP); Isao Itagaki, Abiko (JP)

(73) Assignee: Canon Finetech Nisca Inc., Saitama (JP)

( * ) Notice: Subject to any disclaimer, the term of this patent is extended or adjusted under 35 U.S.C. 154(b) by 132 days.

(21) Appl. No.: 16/548,859

(22) Filed: Aug. 23, 2019

(65) Prior Publication Data

US 2020/0070561 A1 Mar. 5, 2020

(30) Foreign Application Priority Data

Aug. 31, 2018 (JP) ..... JP2018-162545
Jul. 26, 2019 (JP) ..... JP2019-138324

(51) Int. Cl.
*B42C 19/08* (2006.01)
*B42C 3/00* (2006.01)
*B42C 9/00* (2006.01)

(52) U.S. Cl.
CPC ..... *B42C 19/08* (2013.01); *B42C 3/00* (2013.01); *B42C 9/0006* (2013.01)

(58) Field of Classification Search
CPC ..... B42C 3/00; B42C 9/0006; B42C 19/08; B42C 99/00; B42C 1/00; B42C 1/10; B42C 1/12; B42C 1/125
See application file for complete search history.

(56) References Cited

U.S. PATENT DOCUMENTS 5,249,788 A * 10/1993 Helmstadter ..... B65H 1/025 271/10.07
6,288,370 B1 * 9/2001 Ogawa ..... G03D 13/002 219/216
8,231,321 B2 * 7/2012 Hasegawa ..... B26D 7/015 412/38
9,889,668 B2 * 2/2018 Kifuku ..... B41J 2/16585
(Continued)

FOREIGN PATENT DOCUMENTS

JP 2005-305822 A 11/2005

*Primary Examiner* — Justin N Olamit
(74) *Attorney, Agent, or Firm* — Venable LLP

(57) ABSTRACT

A sheet bundle discharging apparatus including: a conveyance belt configured to convey and discharge a sheet bundle in a conveyance direction; an attitude changing unit configured to change an attitude of the sheet bundle from a first attitude in which the sheet bundle is apart from the conveyance belt to a second attitude in which the sheet bundle is placed on the conveyance belt; and a receiving member configured to receive an end portion of the sheet bundle, wherein the attitude changing unit allows the end portion of the sheet bundle to pass through a region in which the conveyance belt is provided, in a belt width direction perpendicular to the conveyance direction, and thereafter reach a region in which the receiving member is provided, a friction coefficient between the sheet bundle and the receiving member being smaller than a friction coefficient between the sheet bundle and the conveyance belt.

10 Claims, 22 Drawing Sheets

(56) References Cited

U.S. PATENT DOCUMENTS

| | | | | |
|---|---|---|---|---|
| 9,890,010 | B2 | 2/2018 | Okamoto | |
| 10,124,980 | B2 | 11/2018 | Okamoto | |
| 2004/0075213 | A1* | 4/2004 | Obama | B65H 5/38<br>271/258.01 |

* cited by examiner

SHEET BUNDLE DISCHARGING APPARATUS AND BOOKBINDING APPARATUS

BACKGROUND OF THE INVENTION

Field of the Invention

The present invention relates to a sheet bundle discharging apparatus configured to discharge a sheet bundle, and to a bookbinding apparatus including the same.

Description of the Related Art

In Japanese Patent Application Laid-Open No. 2005-305822, there is disclosed a bookbinding apparatus including an accommodating section configured to accommodate a plurality of sheet bundles (booklets) which are each formed by binding a plurality of sheets each having an image formed thereon. With regard to this bookbinding apparatus, when the amount of sheet bundles accommodated on the accommodating section reaches a certain amount, it is required to stop the bookbinding operation and cause a user to take out the sheet bundles.

However, with regard to the related-art sheet bundle discharging apparatus, there is a case in which the sheet bundle falls over discharging means in a state of being curved. In such a case, when an end portion of the sheet bundle on the side which has curved and fallen over the discharging means is brought into abutment against the discharging means, and thereafter the sheet bundle becomes flat by its own weight, the end portion may slide on the discharging means and be damaged.

SUMMARY OF THE INVENTION

According to one embodiment of the present invention, a sheet bundle discharging apparatus comprises:

a conveyance belt configured to convey and discharge a sheet bundle in a predetermined conveyance direction;

an attitude changing unit configured to change an attitude of the sheet bundle from a first attitude in which the sheet bundle is apart from the conveyance belt to a second attitude in which the sheet bundle is placed on the conveyance belt; and a receiving member configured to receive an end portion of the sheet bundle in a case where the attitude changing unit changes the attitude of the sheet bundle from the first attitude to the second attitude, wherein, in the case where the attitude changing unit changes the attitude of the sheet bundle from the first attitude to the second attitude, the attitude changing unit allows the end portion of the sheet bundle to pass through a region in which the conveyance belt is provided, in a belt width direction perpendicular to the conveyance direction, and thereafter reach a region in which the receiving member is provided, and wherein a friction coefficient between the sheet bundle and the receiving member is smaller than a friction coefficient between the sheet bundle and the conveyance belt.

Further features of the present invention will become apparent from the following description of exemplary embodiments with reference to the attached drawings.

DESCRIPTION OF THE EMBODIMENTS

Now, with reference to the drawings, description is made of an image forming apparatus which includes a bookbinding apparatus including a sheet bundle discharging apparatus according to an embodiment of the present invention.

Figure 1:
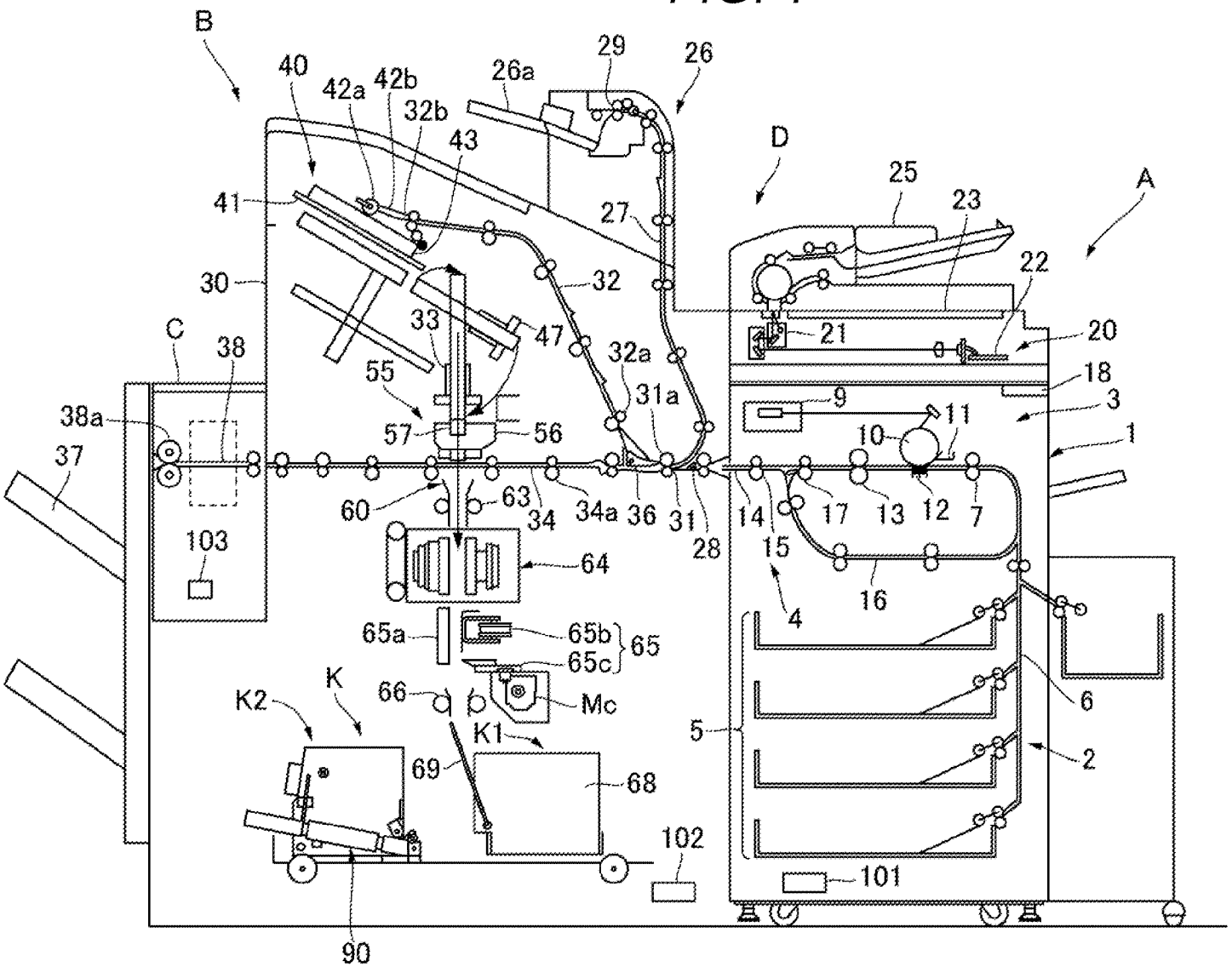
FIG. 1 is a schematic sectional view for illustrating an image forming system taken along a sheet conveyance direction.
Figure 2:
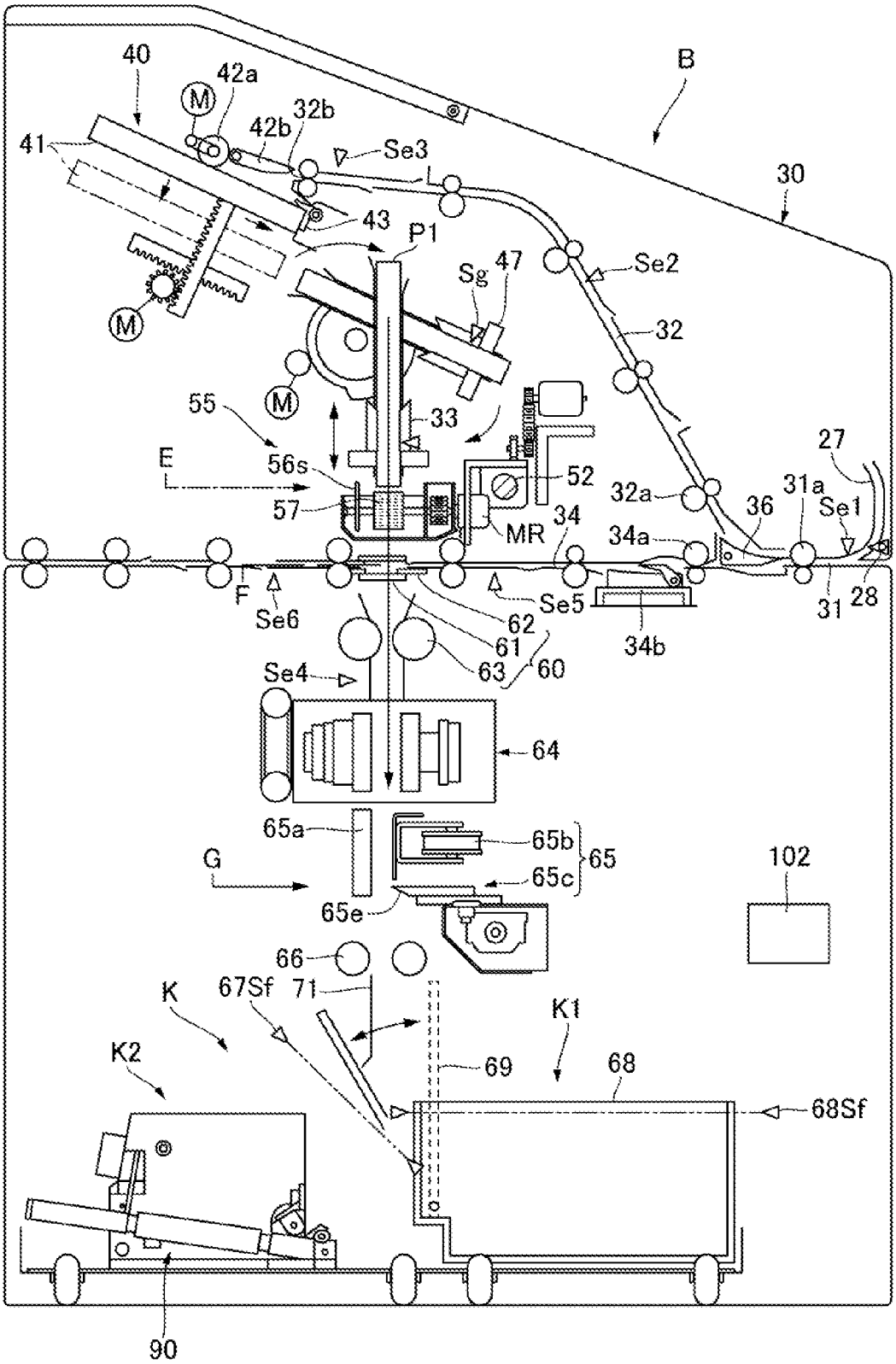
FIG. 2 is a schematic sectional view for illustrating a bookbinding apparatus according to an embodiment of the present invention taken along the sheet conveyance direction.

FIG. 1 is a schematic sectional view for illustrating an image forming system D taken along a sheet conveyance direction. FIG. 2 is a schematic sectional view for illustrating a bookbinding apparatus B taken along the sheet conveyance direction.

The image forming system D includes an image forming apparatus A, the bookbinding apparatus B, and a post-processing apparatus C. The image forming apparatus A is configured to sequentially form toner images on sheets. The bookbinding apparatus B is arranged on a downstream side of the image forming apparatus A. The post-processing apparatus C is arranged downstream of the image forming apparatus A. The image forming system D uses the bookbinding apparatus B to perform bookbinding processing on the sheets having been subjected to image formation in the image forming apparatus A. Further, the image forming system D allows sheets which are not subjected to the bookbinding processing to pass through the bookbinding apparatus B, uses the post-processing apparatus C to perform post-processing on the sheets, and discharges the sheets.

(Image Forming Apparatus A)

The image forming apparatus A is configured to form images on sheets. Examples of the image forming apparatus A may include those of various structures such as a copying machine, a printer, and a printing machine. The image forming apparatus A in this embodiment is a copying machine configured to form toner images on sheets. The image forming apparatus A includes, in an apparatus main body 1 thereof, for example, a sheet supply portion 2, an image forming portion 3, a sheet discharging portion 4, and an image forming apparatus controller 101. In the sheet supply portion 2, a plurality of cassettes 5 corresponding to respective sheet sizes are arrayed in an up-and-down direction. The sheet supply portion 2 sends out a sheet having a size designated by the image forming apparatus controller 101 to a feed passage 6. In the feed passage 6, a registration roller pair 7 is provided. The registration roller pair 7 aligns a leading end of the sheet, and feeds the sheet to the image forming portion 3 on the downstream side at a predetermined timing.

The image forming portion 3 includes an electrostatic drum 10. In a periphery of the electrostatic drum 10, there are provided, for example, a print head 9, a developing device 11, and a transfer charger 12. The print head 9 is formed of, for example, a laser emitter, and is configured to form an electrostatic image on the electrostatic drum 10. The electrostatic image is developed with toner by the developing device 11 to be formed into a toner image, and then is transferred to a sheet by the transfer charger 12. The toner image on the sheet is fixed by a fixing device 13. After that, the sheet is delivered to a sheet discharging passage 17. The sheet discharging portion 4 has a sheet discharging port 14, and a sheet discharging roller pair 15 is arranged thereat. In a circulation passage 16, the sheet having been delivered from the sheet discharging passage 17 is reversed front and back in a switchback passage, and thereafter is guided to the registration roller pair 7 again. A toner image is formed on a back surface of the sheet by the image forming portion 3. In such a manner, the sheet having the toner image formed on one side or both sides is fed from the sheet discharging port 14 to the bookbinding apparatus B by the sheet discharging roller pair 15.

A scanner unit 20 provided on top of the apparatus main body 1 is configured to optically read an image of an original. The scanner unit 20 includes a platen glass 23, a carriage 21, and an optical reader (for example, CCD device) 22. The platen glass 23 is configured to receive an original to be placed thereon by a user. The carriage 21 is configured to optically read an original along the platen glass 23. The optical reader 22 is configured to perform photoelectric conversion on an optical image transmitted from the carriage 21. Further, the scanner unit 20 includes, on top thereof, an original feeder 25 configured to automatically feed an original to the platen glass 23.

(Bookbinding Apparatus B)

FIG. 2 is a schematic sectional view for illustrating the bookbinding apparatus B taken along the sheet conveyance direction. The bookbinding apparatus B is connected to the image forming apparatus A.

In the following description, a sheet which serves as a cover of a sheet bundle is referred to as "cover". A sheet covered with the cover is referred to as "inner sheet". A bundle of inner sheets is referred to as "inner sheet bundle". The inner sheet bundle covered with the cover is referred to as "sheet bundle covered with the cover". A sheet bundle covered with the cover which has been trimmed is referred to as "booklet". Those sheet bundles are simply referred to as "sheet bundle" in some parts.

The bookbinding apparatus B includes a casing 30, a stacking portion 40, an adhesive applying portion 55, a cover binding portion 60, a sheet bundle rotating portion 64, a cutting portion 65, and a sheet bundle discharging apparatus K. The stacking portion 40 is provided in the casing 30, and is configured to stack inner sheets having toner images formed thereon into a bundle and align the bundle. The adhesive applying portion 55 is configured to apply an adhesive to the inner sheet bundle from the stacking portion 40. The cover binding portion 60 is configured to bind a cover on the inner sheet bundle having the adhesive applied thereto. The sheet bundle rotating portion 64 is configured to change an orientation of the sheet bundle covered with the cover to which the cover has been bound. The cutting portion 65 is configured to perform trim-cutting on an edge of the sheet bundle having been changed in orientation. The sheet bundle discharging apparatus K is configured to discharge the booklet formed through the trim-cutting.

(Configuration of Conveyance Passage)

Description is made of each conveyance passage for the sheets. In the casing 30, there is provided a carry-in passage 31 which continues from the sheet discharge port 14 of the image forming apparatus A. The carry-in passage 31 is connected to an inner sheet conveyance passage 32 and a cover conveyance passage 34 through intermediation of a passage switching member 36. The inner sheet conveyance passage 32 is connected to a bookbinding passage 33 through intermediation of the stacking portion 40. The cover conveyance passage 34 is connected to a post-processing passage 38 of the post-processing apparatus C (FIG. 1) described later. The bookbinding passage 33 extends vertically through the bookbinding apparatus B in a substantially vertical direction. The cover conveyance passage 34 extends horizontally through the bookbinding apparatus B in a substantially horizontal direction. Therefore, the bookbinding passage 33 and the cover conveyance passage 34 cross each other (are orthogonal to each other), and the cover binding portion 60 described later is arranged at the crossing part.

With the configuration of the conveyance passages as described above, the carry-in passage 31 receives, from the image forming apparatus A, sheets (inner sheets) having toner images formed thereon. In this case, the inner sheets and a print sheet (cover), which is to be used as a cover and has a title and the like printed thereon, are fed from the image forming apparatus A. The inner sheets and the cover are selectively delivered to the inner sheet conveyance passage 32 and the cover conveyance passage 34 by the passage switching member 36.

Moreover, an inserter apparatus 26 is connected to the carry-in passage 31 (FIG. 1). The inserter apparatus 26 is configured to feed covers, which are not subjected to printing in the image forming apparatus A, one after another from a feed tray 26*a* to the carry-in passage 31. The inserter apparatus 26 includes one or a plurality of feed tray 26*a*, a cover feeding portion 29, and a cover feeding passage 27. The cover feeding portion 29 is arranged at a distal end of the tray, and is configured to separate and feed one after another sheets stacked on the feed tray 26*a*. The cover feeding passage 27 is provided on a downstream side of the cover feeding portion 29. The cover feeding passage 27 is connected to the carry-in passage 31 through intermediation of the passage switching member 28. A conveyance roller pair 31*a* is arranged on the carry-in passage 31. A conveyance roller pair 32*a* is arranged on the inner sheet conveyance passage 32. On the bookbinding passage 33, there are provided a grip conveyance portion 47, a sheet bundle rotating portion 64 described later, and a sheet bundle discharging roller pair 66. A conveyance roller pair 34*a* is arranged on the cover conveyance passage 34, and a conveyance roller pair 38*a* is arranged on the post-processing passage 38 of the post-processing apparatus C (FIG. 1) described later. The conveyance roller pair 34*a* and the conveyance roller pair 38*a* are rotated by respective drives motors (not shown) to feed the inner sheets and the cover.

(Post-Processing Apparatus C)

As illustrated in FIG. 1, the post-processing apparatus C is connected to the bookbinding apparatus B. The post-processing apparatus C includes the post-processing passage 38 continuing from the cover conveyance passage 34. The post-processing apparatus C include any one of a stapling unit, a punching unit, and a stamping unit as a post-processing device connected to the post-processing passage 38. The post-processing passage 38 receives, through the cover conveyance passage 34, sheets having been subjected to image formation and delivered from the image forming apparatus A. The post-processing apparatus C performs post-processing such as stapling, punching, or stamping on the sheets having been subjected to image formation. Then, the post-processing apparatus C conveys the sheets having been subjected to image formation to a discharge tray 37. Moreover, in some cases, the post-processing apparatus C discharges the sheets having been subjected to image formation to the discharge tray 37 without performing the post-processing.

(Stacking Portion 40)

A stack tray 41 arranged at the inner sheet discharging port 32*b* of the inner sheet conveyance passage 32 is configured to stack and accommodate the inner sheets, which have been discharged from the inner sheet discharging port 32*b*, in a bundle shape. As illustrated in FIG. 2, the stack tray 41 is formed of a tray member arranged in a substantially horizontal attitude, and there are arranged a forward/reverse rotation roller 42*a* and a carry-in guide 42*b* above the stack tray 41. Then, the inner sheets having been discharged from the inner sheet discharging port 32*b* are guided to a position above the stack tray 41 by the carry-in guide 42*b*, and are accommodated on the stack tray 41 by the forward/reverse rotation roller 42*a*. The forward/reverse rotation roller 42*a* performs forward rotation to deliver the inner sheets toward a distal end side of the stack tray 41, and performs reverse rotation to bring a trailing edge of the inner sheets into abutment against a regulation member 43 arranged at a tray rear end (right end in FIG. 2), to thereby regulate the inner sheets. A pair of sheet side alignment plates (not shown) are provided to the stack tray 41, and the sheet side alignment plates align both side edges of the inner sheets accommodated on the stack tray 41. Moreover, along with stacking of the inner sheets, the stack tray 41 is lowered from the position indicated by the solid lines to the position indicated by the broken lines. With such a configuration, the inner sheets having been delivered from the inner sheet conveyance passage 32 are sequentially stacked on the stack tray 41, and then are aligned into a bundle shape.

(Grip Conveyance Portion 47)

A grip conveyance portion 47 is provided on the bookbinding passage 33. The grip conveyance portion 47 is configured to deliver the sheets from the stack tray 41 to an adhesive applying position E on the downstream side. The stack tray 41 passes the inner sheet bundle to the grip conveyance portion 47 which waits at a substantially horizontal passing position. As illustrated in FIG. 2, the grip conveyance portion 47 changes an attitude of the inner sheet bundle stacked on the stack tray 41 from a substantially horizontal attitude to a vertical attitude. Then, the grip conveyance portion 47 sets the inner sheet bundle at the adhesive applying position E so that the inner sheet bundle is placed along the bookbinding passage 33 arranged so as to extend in a substantially vertical direction.

(Adhesive Applying Portion 55)

Figure 3A:
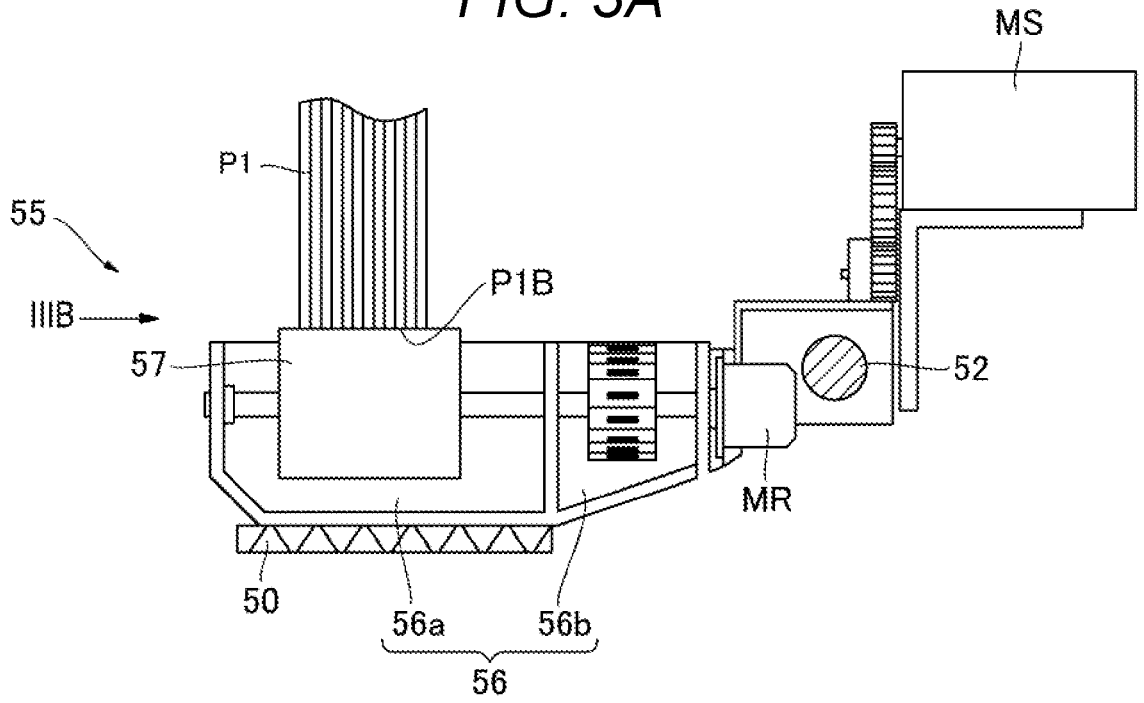
FIG. 3A is a front view for illustrating an adhesive applying portion of the bookbinding apparatus.
Figure 3B:
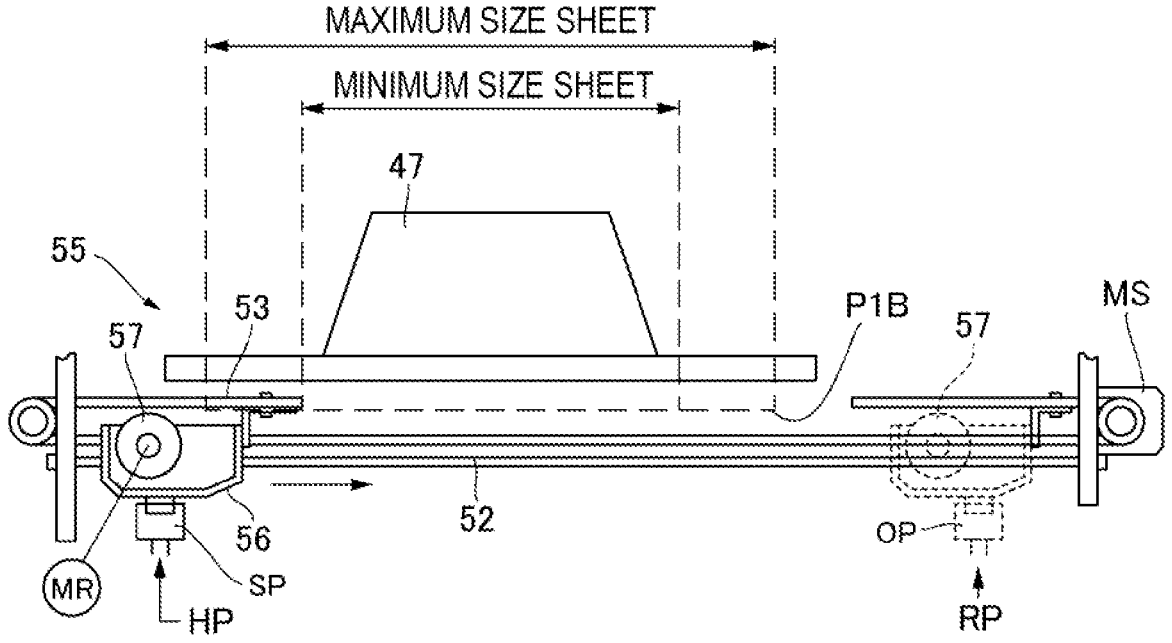
FIG. 3B is a view as seen in a direction indicated by the arrow IIIB of FIG. 3A.
Figure 18:
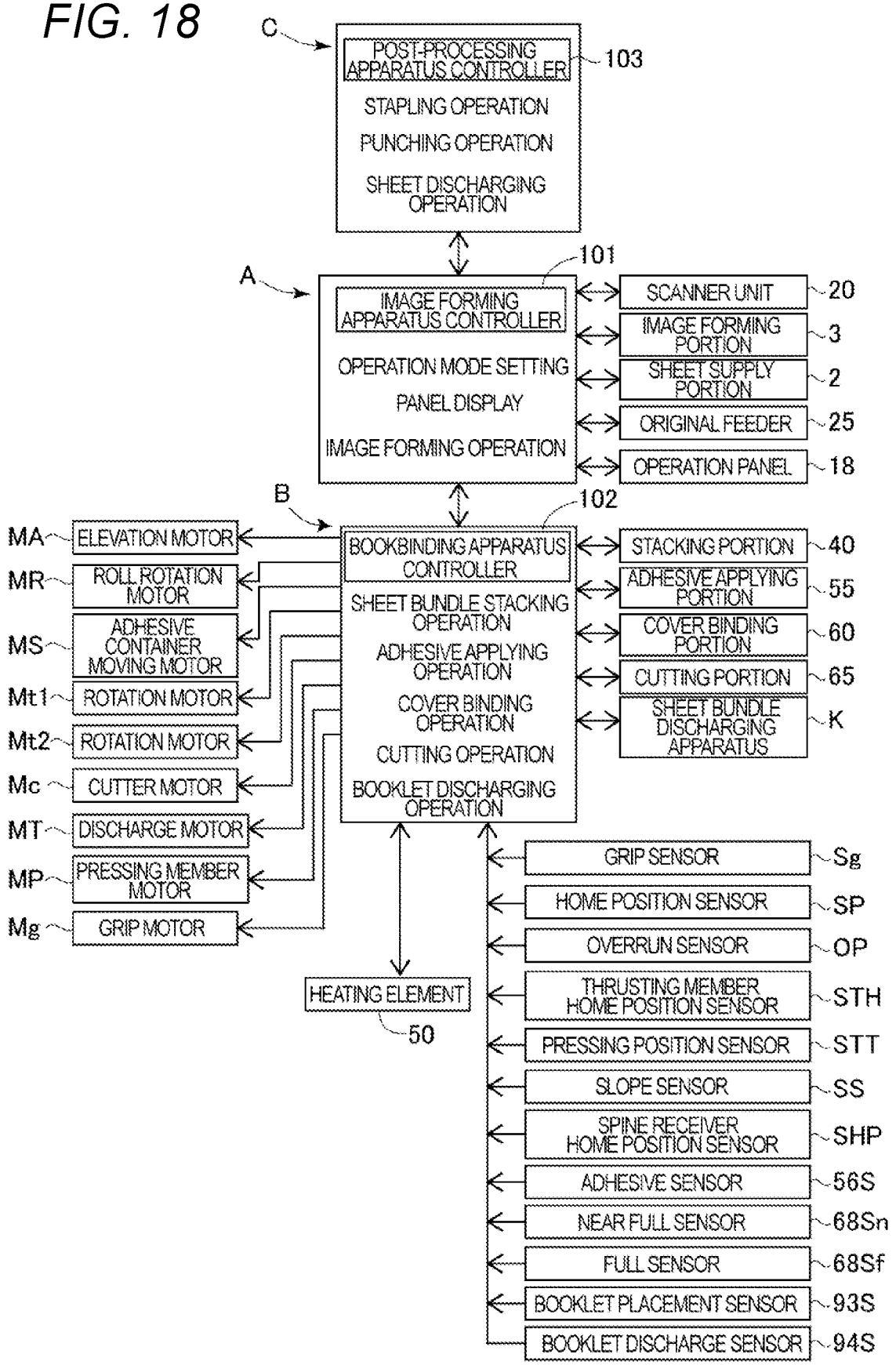
FIG. 18 is a control block diagram for illustrating an image forming system.

FIG. 3A and FIG. 3B are views for illustrating the adhesive applying portion 55. FIG. 3A is a front view. FIG. 3B is a view as seen in a direction indicated by the arrow IIIB of FIG. 3A. As illustrated in FIG. 2, FIG. 3A, and FIG. 3B, the adhesive applying portion 55 is arranged at the adhesive applying position E on the bookbinding passage 33. The adhesive applying portion 55 includes an adhesive container 56, an applying roll 57, and a roll rotation motor MR. The adhesive container 56 is configured to accommodate a thermally meltable adhesive. The adhesive container 56 includes a liquid adhesive accommodating chamber 56*a* and a solid adhesive accommodating chamber 56*b*. The applying roll 57 is rotatably incorporated into the liquid adhesive accommodating chamber 56*a*. An adhesive sensor 56*s* (FIG. 2) configured to detect a remaining amount of the adhesive is provided in the liquid adhesive accommodating chamber 56*a*. The adhesive sensor 56*s* serves also as a temperature sensor configured to detect a temperature of the adhesive. That is, the adhesive sensor 56*s* is configured to detect a temperature of the liquefied adhesive in the liquid adhesive accommodating chamber 56*a*, and at the same time, detect a remaining amount of the adhesive based on a temperature difference at a part soaked in the adhesive. Further, a heating element 50 such as an electrothermal heater is provided to the adhesive container 56. The adhesive sensor 56*s* and the heating element 50 are connected to a bookbinding apparatus controller 102 (FIG. 1 and FIG. 18). The bookbinding apparatus controller 102 is configured to adjust a temperature of the adhesive in the liquid adhesive accommodating chamber 56*a* to a predetermined melting temperature based on a detected temperature of the heating element 50. The applying roll 57 is formed of a heat-resistant porous material, and is configured to allow the adhesive to be impregnated thereinto to thereby allow a layer of the adhesive to bulge on a periphery of the roll.

The adhesive container 56 having the configuration as described above is driven to reciprocate along a back side of the inner sheet bundle. As illustrated in FIG. 3B, the adhesive container 56 is formed so as to have a length (dimension) shorter than a lower end edge (back cover portion at the time of bookbinding) P1B of the inner sheet bundle, and is supported on a guide rail 52 of the casing 30 (FIG. 2) so as to be movable along the lower end edge P1B of the inner sheet bundle P1 together with the applying roll 57 provided inside the adhesive container 56. The adhesive container 56 is coupled to a timing belt 53, and an adhesive container moving motor MS is coupled to the timing belt 53.

The adhesive container 56 is guided by the guide rail 52 between a home position HP on the left side in FIG. 3B and a return position RP on the right side in FIG. 3B at which the returning operation along the sheet bundle is started, and is reciprocated by the adhesive container moving motor MS. The return position RP is set based on size information of a sheet width. The bookbinding apparatus controller 102 (FIG. 18) uses the home position sensor SP to detect that the adhesive container 56 is at the home position HP. The adhesive container 56 waits at the home position HP when an apparatus power supply is turned on (in an initial state). Then, the bookbinding apparatus controller 102 moves the adhesive container 56 from the home position HP to the return position RP after elapse of a predetermined time (estimated time for the sheet bundle to arrive at the adhesive applying position E) from reception of a sheet grip signal of a grip sensor Sg (FIG. 2) provided to, for example, the preceding grip conveyance portion 47. A position of the adhesive container 56 can be detected by counting drive pulses of the adhesive container moving motor MS. An overrun sensor OP may be provided to the return position RP as illustrated in FIG. 3B, and the bookbinding apparatus controller 102 may prevent overrun of the adhesive container 56 based on a detection result of the overrun sensor OP. Simultaneously with the movement of the adhesive container 56 from the home position HP to the return position RP, the applying roll 57 starts rotation by the roll rotation motor MR. The adhesive applying portion 55 having such a configuration starts movement from the left side toward the right side in FIG. 3B through the rotation of the adhesive container moving motor MS and the guidance with the guide rail 52. On the forward passage, the applying roll 57 is held in pressure contact with the sheet bundle to loosen the end portion of the sheet bundle. Further, on the return path for returning from the return position RP to the home position HP, the bookbinding apparatus controller 102 uses an elevation motor (not shown) to adjust the delivery amount of the grip conveyance portion 47 so as to allow the applying roll 57 and the end portion of the sheet bundle to define a predetermined gap. Then, the bookbinding apparatus controller 102 applies the adhesive to the end portion of the sheet bundle through the movement on the return passage of the applying roll 57.

(Cover Binding Portion 60)

Figure 4:
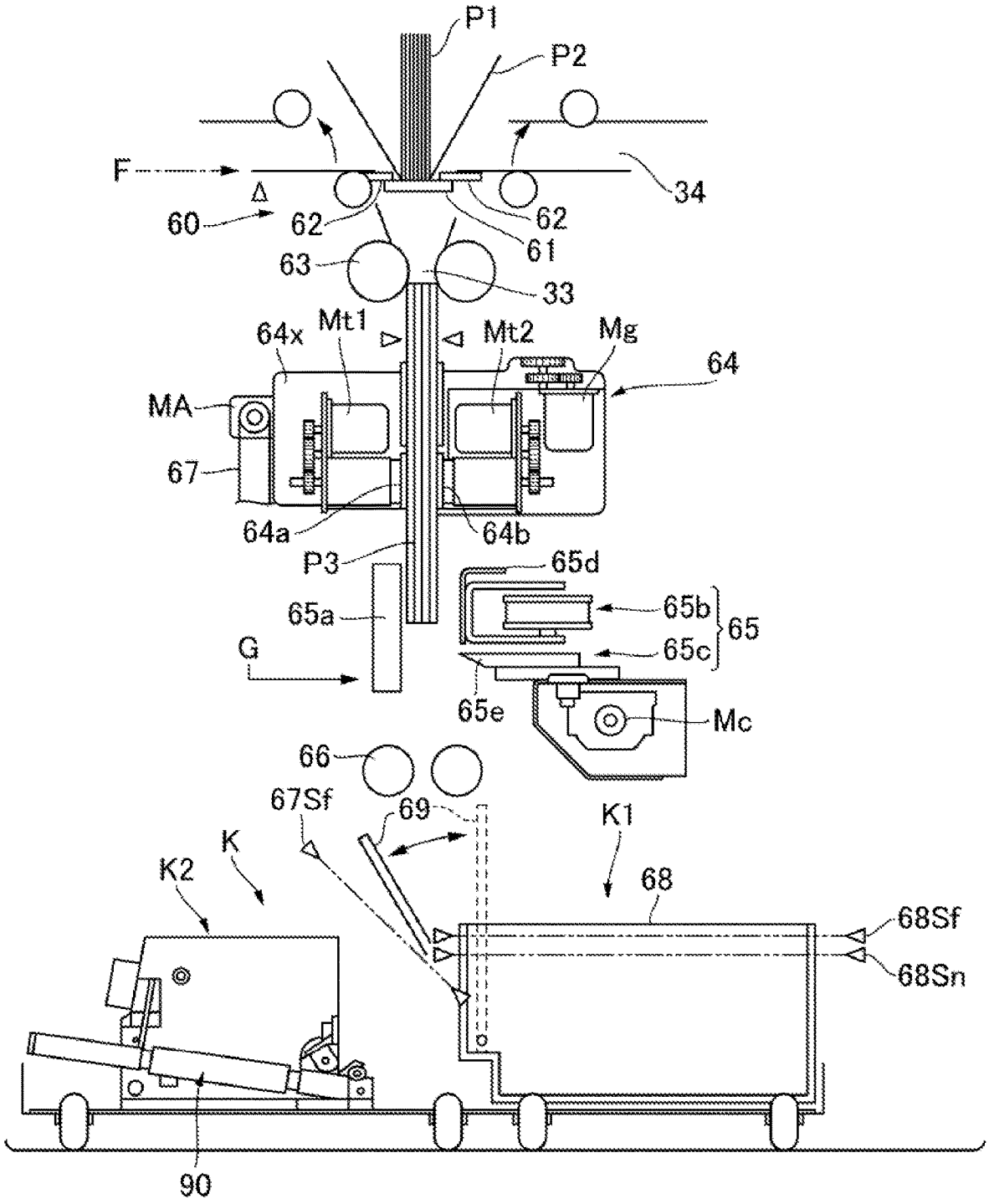
FIG. 4 is a view for illustrating a cover binding portion, a sheet bundle rotating portion, a cutting portion, and a discharging portion.

FIG. 4 is a view for illustrating the cover binding portion 60, the sheet bundle rotating portion 64, the cutting portion 65, and the sheet bundle discharging apparatus K. The cover binding portion 60 is provided at a cover binding position F on the bookbinding passage 33. The cover binding portion 60 serving as a binding unit includes an abutment plate 61, folding plates 62, and a folding roller pair 63. The cover conveyance passage 34 is arranged at the cover binding position F, and the cover is fed from the image forming apparatus A or the inserter apparatus 26. The abutment plate 61 is formed of a plate-shaped member configured to back up the cover, and is arranged on the bookbinding passage 33 so as to be able to freely advance and retreat. A cover P2 supported by the abutment plate 61 and an inner sheet bundle P1 are joined to each other in a reversed T shape. The folding plates 62 are formed of a pair of right and left press members. In order to fold a spine of the cover joined to the inner sheet bundle P1, the folding plates 62 approach and separate from each other by a driving portion (not shown). The folding plates 62 approach each other to fold the spine of the cover P2 to thereby form a shape. The folding roller pair 63 sandwiches and pressurizes a sheet bundle P3 covered with the cover to finish the covering.

(Sheet Bundle Rotating Portion 64 and Cutting Portion 65)

As illustrated in FIG. 4, on the downstream side of the folding roller pair 63, there is arranged the sheet bundle rotating portion 64 configured to rotate the sheet bundle P3 covered with the cover to change a direction of the sheet bundle P3. At a cutting position G located on the downstream side of the sheet bundle rotating portion 64, there is provided the cutting portion 65 configured to cut a peripheral edge of the sheet bundle P3 covered with the cover. The sheet bundle rotating portion 64 is configured to allow the sheet bundle P3 covered with the cover to be oriented in a predetermined direction from the cover binding position E (FIG. 2) and feed the sheet bundle P3 to the cutting portion 65 or the sheet bundle discharging apparatus K on the downstream side. The cutting portion 65 is configured to trim the peripheral edge being a portion to be cut of the sheet bundle covered with the cover. Therefore, the sheet bundle rotating portion 64 includes rotation tables 64*a* and 64*b* configured to grip and rotate the sheet bundle P3 covered with the cover having been delivered from the folding roller pair 63. The rotation tables 64*a* and 64*b* are provided on a unit frame 64*x* mounted to the casing 30 (FIG. 2) so as to be able to be freely elevated. On the unit frame 64*x*, the pair of rotation tables 64*a* and 64*b* are arranged across the bookbinding passage 33 and are axially supported so as to be freely rotatable. One rotation table 64*b* is supported on the unit frame 64*x* so as to freely move in a thickness direction (direction orthogonal to the bookbinding passage 33) of the sheet bundle P3 covered with the cover. The rotation motors Mt1 and Mt2 configured to rotate the sheet bundle P3 covered with the cover in the bookbinding passage 33 are provided for the rotation tables 64*a* and 64*b*, respectively. Further, a grip motor Mg configured to move in a right-and-left direction in FIG. 4 is mounted to the rotation table 64*b* on the movable side. The unit frame 64*x* allows, through use of an elevation motor MA, the sheet bundle P3 covered with the cover to be elevated along the bookbinding passage 33. The elevation motor MA is fixed to a fixing member (not shown). The elevation motor MA is configured to circulate a belt 67 coupled to the unit frame 64*x*, to thereby elevate the unit frame 64*x*.

The sheet bundle P3 covered with the cover having been guided into the bookbinding passage 33 is gripped by the pair of left and right rotation tables 64*a* and 64*b* and is rotated by the rotation motors Mt1 and Mt2. The rotation tables 64*a* and 64*b* are capable of rotating the sheet bundle P3 covered with the cover, which has been conveyed with the spine arranged on a lower side, by 180 degrees and delivering the sheet bundle P3 with a fore edge thereof to the sheet bundle discharging roller pair 66 on the downstream side. Moreover, the rotation tables 64*a* and 64*b* are capable of rotating the sheet bundle P3 covered with the cover sequentially by 90 degrees. Then, the rotation tables 64*a* and 64*b* are capable of rotating the sheet bundle P3 covered with the cover so that a top portion, a base portion, and the fore edge of the sheet bundle P3 covered with the cover are oriented toward the cutting position G, and enable trimming and cutting of each end portion. A grip sensor (not shown) is provided to the rotation table 64*b* on the movable side. The bookbinding apparatus controller 102 uses the grip sensor to detect that the sheet bundle P3 covered with the cover is reliably gripped between the left and right rotation tables 64*a* and 64*b*. Then, after the detection, the bookbinding apparatus controller 102 drives the rotation tables 64*a* and 64*b* to rotate.

(Cutting Portion 65)

As illustrated in FIG. 4, the cutting portion 65 is arranged on the downstream side of the sheet bundle rotating portion 64. The cutting portion 65 includes a blade receiving member 65*a*, a cut edge pressing unit 65*b*, and a cutting blade unit 65*c*. The cut edge pressing unit 65*b* is configured to press and hold a cut edge of the sheet bundle P3 covered with the cover against the blade receiving member 65*a*. The cutting blade unit 65*c* is configured to cut the cut edge. The cut edge pressing unit 65*b* is arranged at a position opposed to the blade receiving member 65*a* arranged on the bookbinding passage 33. The cut edge pressing unit 65*b* includes a pressurizing member 65*d* configured to be driven by a driving portion (not shown) to move in a direction perpendicular to the sheet bundle P3 covered with the cover. The cutting blade unit 65*c* includes a cutting blade 65*e* and a cutter motor MC. The cutting blade 65*e* has a flat blade shape. The cutter motor MC is configured to drive the cutting blade 65*e*. The cutting portion 65 having such a configuration is configured to perform trim-cutting, which is an operation of cutting and trimming a predetermined amount of a peripheral edge (cut edge) excluding the spine of the sheet bundle P3 covered with the cover.

(Sheet Bundle Discharging Apparatus K)

As illustrated in FIG. 4, the sheet bundle discharging apparatus K is arranged below the cutting position G, and includes, for example, a cutting scrap collecting portion K1 and a sheet bundle discharging portion K2.

(Cutting Scrap Collecting Portion K1)

As illustrated in FIG. 4, the cutting scrap collecting portion K1 includes, for example, a sweeper portion 69, a cutting scrap collecting container 68, a full sensor 68Sf, and a near full sensor 68Sn, and is configured to accommodate a cutting scrap cut by the cutting blade 65*e*.

The sweeper portion 69 is provided immediately below the cutting position G. The sweeper portion 69 is driven by a driving motor (not shown) to rotate between a position indicated by the solid lines and a position indicated by the broken lines in FIG. 4. When the cutting portion 65 cuts the cut edge of the sheet bundle covered with the cover, the sweeper portion 69 waits in an inclined state at the position indicated by the solid lines for receiving the cutting scrap formed by the cutting. As illustrated in FIG. 2, when the sweeper portion 69 and a discharging guide 71 described later are each formed into a comb-teeth shape so as not to interfere with each other when the sweeper portion 69 rotates.

As illustrated in FIG. 4, the sweeper portion 69 waiting at the position indicated by the solid lines receives the cutting scrap, which is formed in the cutting portion 65 and falls through the sheet bundle discharging roller pair 66, and guides the cutting scrap into the cutting scrap collecting container 68 through use of the inclination. On this occasion, the sheet bundle covered with the cover is held by the rotation tables 64*a* and 64*b* and hence do not fall. When the cutting processing by the cutting portion 65 on the sheet bundle covered with the cover is terminated, the sweeper portion 69 rotates to the position indicated by the broken lines, which is a position avoiding the location directly below the sheet bundle discharging roller pair 66 and is close to the cutting scrap collecting container 68. As a result, the sweeper portion 69 does not hinder falling of the booklet, which is released from being held by the rotation tables 64*a* and 64*b* and is discharged from the sheet bundle discharging roller pair 66. The booklet falls onto the sheet bundle discharging portion K2.

The bookbinding apparatus controller 102 (FIG. 18) uses the near full sensor 68Sn to detect that the cutting scrap of a predetermined amount less than full has been collected to the cutting scrap collecting container 68. When the near full sensor 68Sn detects the cutting scrap, the bookbinding apparatus controller 102 (FIG. 18) displays through the image forming apparatus controller 101 a collection state of the cutting scrap on an operation panel 18 (FIG. 1 and FIG. 18) of the image forming apparatus A. Further, the bookbinding apparatus controller 102 (FIG. 18) uses the full sensor 68Sf to detect that the cutting scrap collecting container 68 has been fully filled with the cutting scrap having been collected. When the full sensor 68Sf detects the cutting scrap, the bookbinding apparatus controller 102 (FIG. 18) displays through the image forming apparatus controller 101 a state in which the cutting scrap collecting container 68 has been fully filled on the operation panel 18 (FIG. 1 and FIG. 18) of the image forming apparatus A.

(Sheet Bundle Discharging Portion K2)

Figure 5:
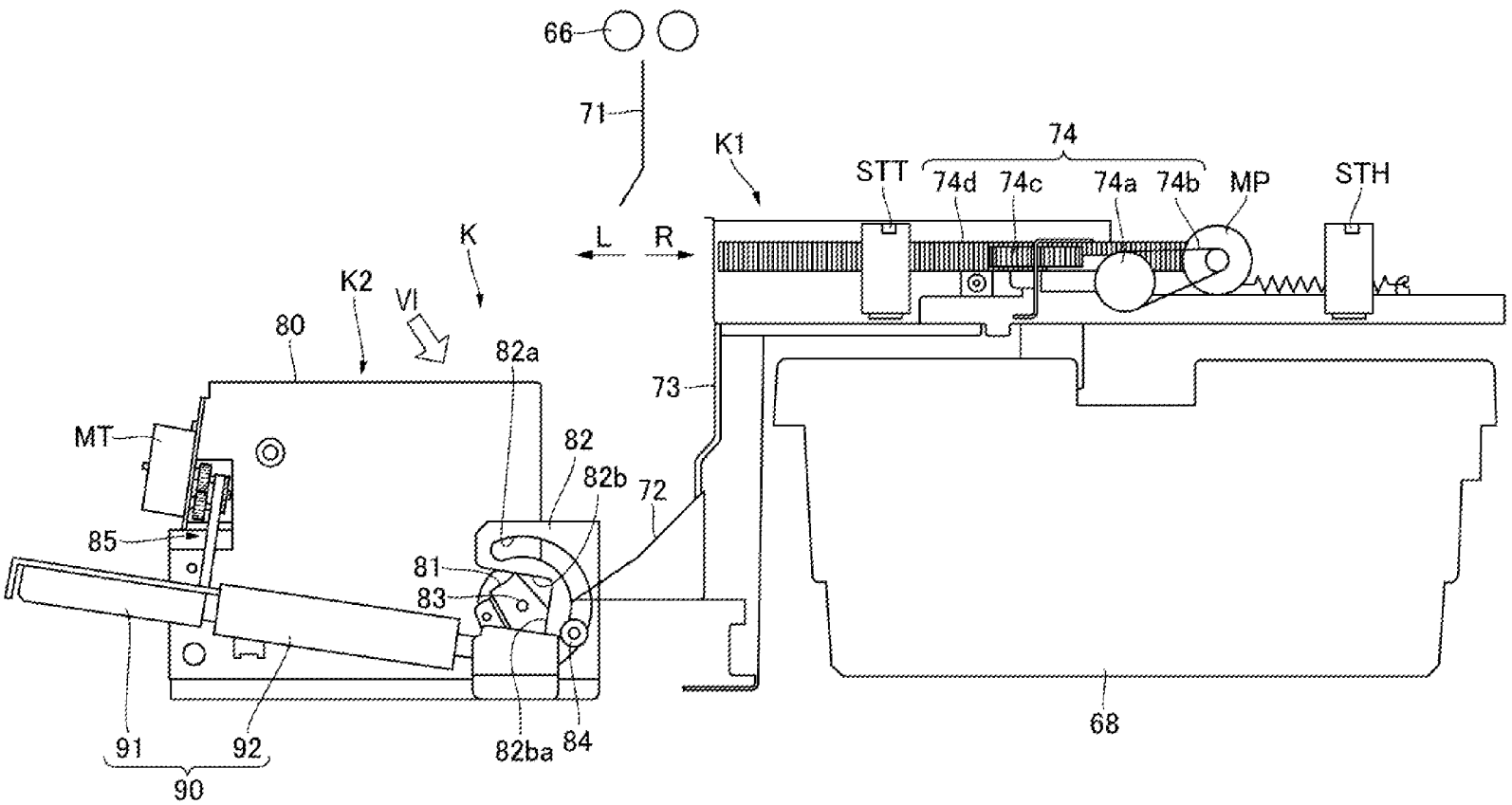
FIG. 5 is a schematic view for illustrating a sheet bundle discharging apparatus, and is an illustration of a state in which a spine receiver waits at a position of being brought into abutment against a booklet.
Figure 6:
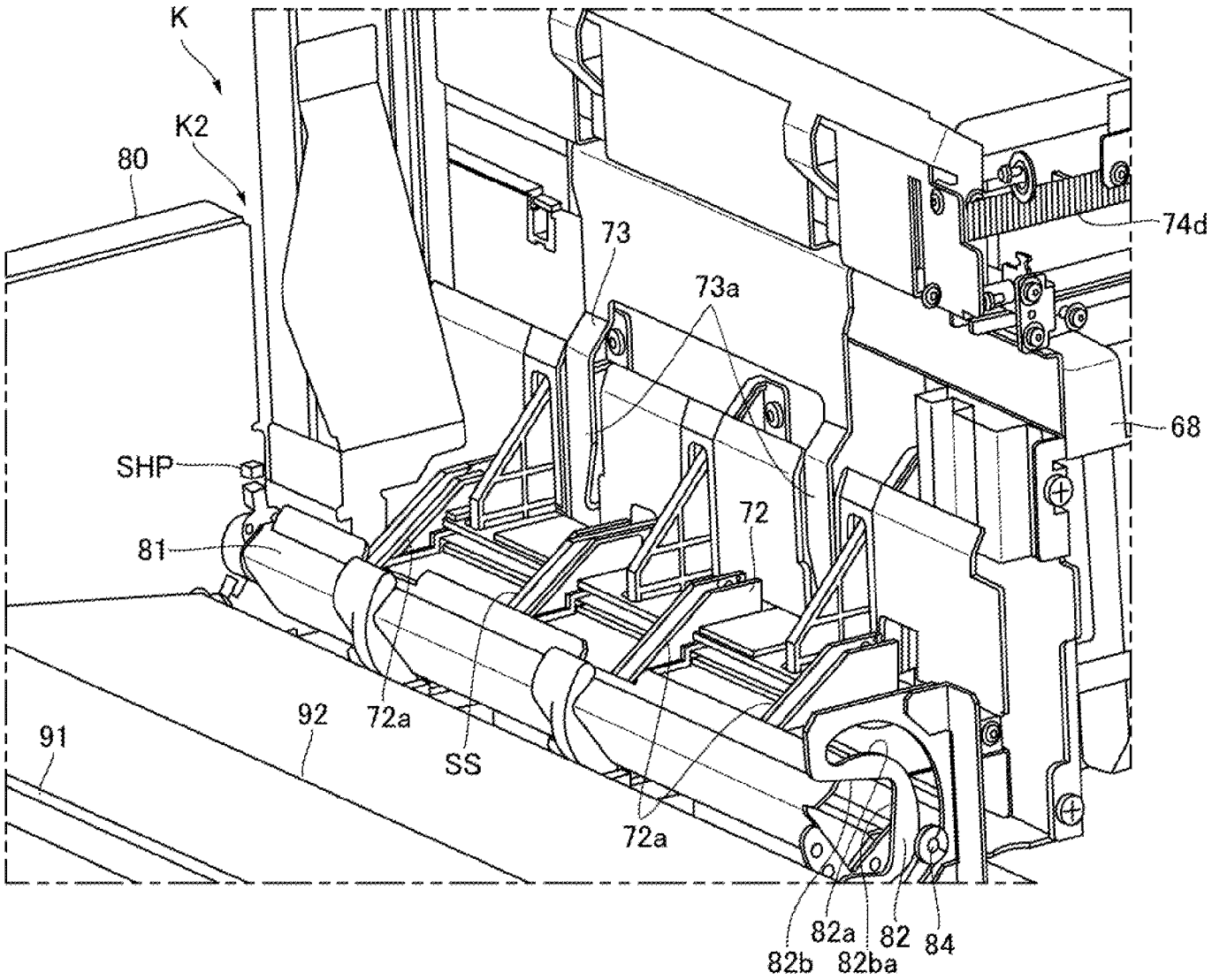
FIG. 6 is a view as seen in a direction indicated by the arrow VI of FIG. 5.

FIG. 5 is a schematic view for illustrating the sheet bundle discharging apparatus K, and is an illustration of a state in which the spine receiver 81 waits at a waiting position of being brought into abutment against the booklet. FIG. 6 is a view as seen in a direction indicated by the arrow VI of FIG. 5. As illustrated in FIG. 1, FIG. 2, and FIG. 4, the sheet bundle discharging portion K2 is arranged on a lower side (on downstream) with respect to the sheet bundle discharging roller pair 66 and the discharging guide 71. As illustrated in FIG. 5 and FIG. 6, the sheet bundle discharging portion K2 includes a pressing member 73, a slope 72, the spine receiver 81, a sheet bundle discharging portion 90, a spine receiver home position sensor SHP (FIG. 6), a slope sensor SS, a pressing member home position sensor STH (FIG. 5), and a pressing position sensor STT.

A pressing member 73 is provided on an upper part of the cutting scrap collecting container 68. The pressing member 73 is provided on the upper part of the cutting scrap collecting container 68 so as to be freely reciprocable by a pressing member driving portion 74 in directions (directions indicated by the arrows L and R) perpendicular to a direction in which the booklet falls from the sheet bundle discharging roller pair 66. The pressing member driving portion 74 includes, for example, a pressing member motor MP, a pulley 74*a*, a belt 74*b*, a pinion 74*c*, and a rack 74*d*. The pressing member motor MP is provided on the upper part of the cutting scrap collecting container 68. The belt 74*b* is stretched around the pressing member motor MP and the pulley 74*a*. The pinion 74*c* is in rotation conjugation with the pulley 74*a* through intermediation of a gear mechanism (not shown). The rack 74*d* is provided to the pressing member 73 so as to extend in a longitudinal direction of the pressing member 73 and is held in mesh with the pinion 74*c*. The pressing member driving portion 74 is configured to transmit a rotary force of the pressing member motor MP to the pinion 74*c* through the belt 74*b* and the pulley 74*a*, to thereby allow the pressing member 73 to reciprocate integrally with the rack 74*d* in the directions indicated by the arrows L and R. An attitude of the booklet P4 is changed through use of the pressing member 73 and the pressing member driving portion 74.

Figure 7:
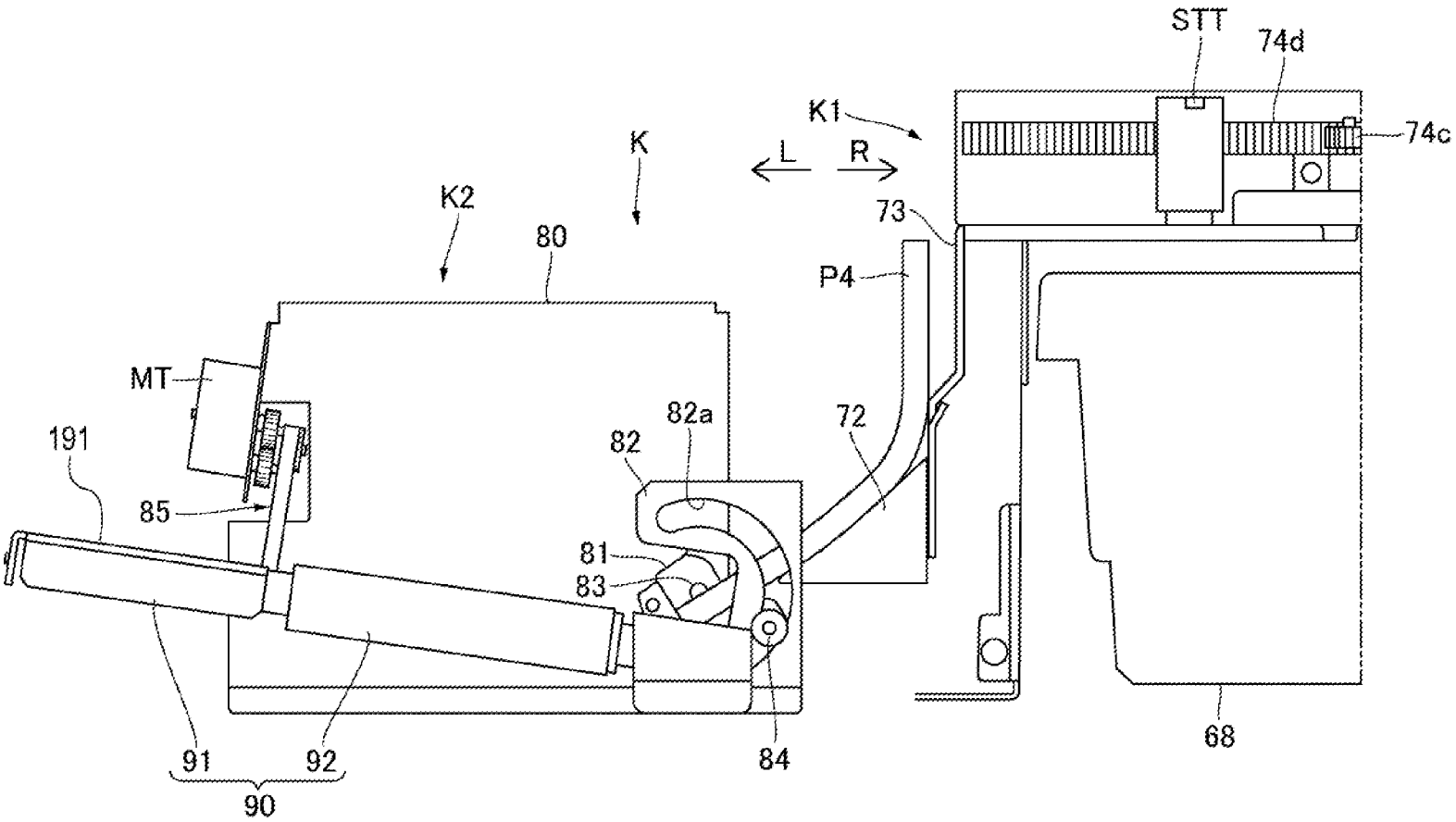
FIG. 7 is an illustration of a state in which, in the sheet bundle discharging apparatus of FIG. 5, the spine receiver is held in abutment against the booklet at a waiting position.

FIG. 7 is an illustration of a state in which, in the sheet bundle discharging apparatus K of FIG. 5, the spine receiver 81 is held in abutment against the booklet P4 at a booklet receiving position (waiting position).

Figure 8:
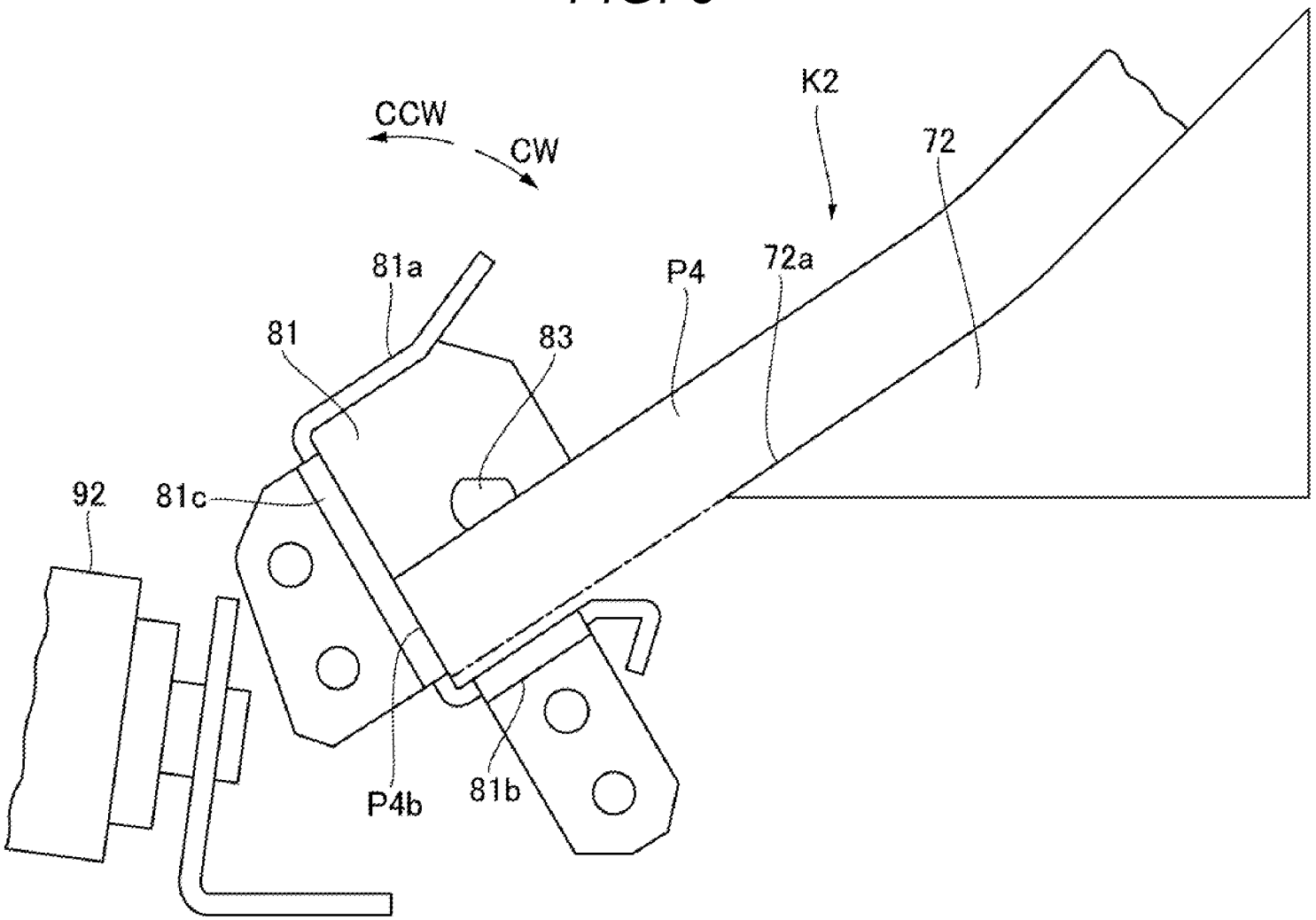
FIG. 8 is an enlarged view for illustrating a portion of the spine receiver of FIG. 7.

FIG. 8 is an enlarged view for illustrating a portion of the spine receiver 81 of FIG. 7.

As illustrated in FIG. 7 and FIG. 8, on a frame 80 of the sheet bundle discharging portion K2, the spine receiver 81 having a gutter-shaped cross section is provided so as to reciprocally rotate in the same directions (arrow CCW direction and arrow CW direction) as moving directions of the pressing member 73. The spine receiver 81 is a support member configured to support a spine P4*b* being a downstream end portion in the conveyance direction of the booklet P4 having been conveyed. The spine receiver 81 rotates to place the booklet P4 on a conveyance belt 92. The conveyance belt 92 is a circulating endless belt. On the spine receiver 81, in the state illustrated in FIG. 7, a support shaft 83 described later is provided so as to project on a far-side end portion of the spine receiver 81, and a guide shaft 84 is provided so as to project on a near-side end portion of the spine receiver 81. With the support shaft 83 being freely rotatably supported on the frame 80, the spine receiver 81 rotates in the arrow CCW direction and the arrow CW direction. The spine receiver 81 includes a spine receiver bottom plate (bottom portion) 81*c*, a spine receiver upper guide (side surface) 81*a*, and a spine receiver lower guide 81*b* (side surface). The spine receiver bottom plate 81*c* is brought into abutment against the spine P4*b* of the booklet P4 to be moved thereto. The spine receiver upper guide 81*a* and the spine receiver lower guide 81*b* are adjacent to the spine receiver bottom plate 81*c* and are parallel to each other. Further, the spine receiver 81 is formed as an elongated gutter-shaped member and as a rotatable member. The spine receiver upper guide 81*a* and the spine receiver lower guide 81*b* are parallel to each other and are substantially perpendicular to the spine receiver bottom plate 81*c*.

Figure 9:
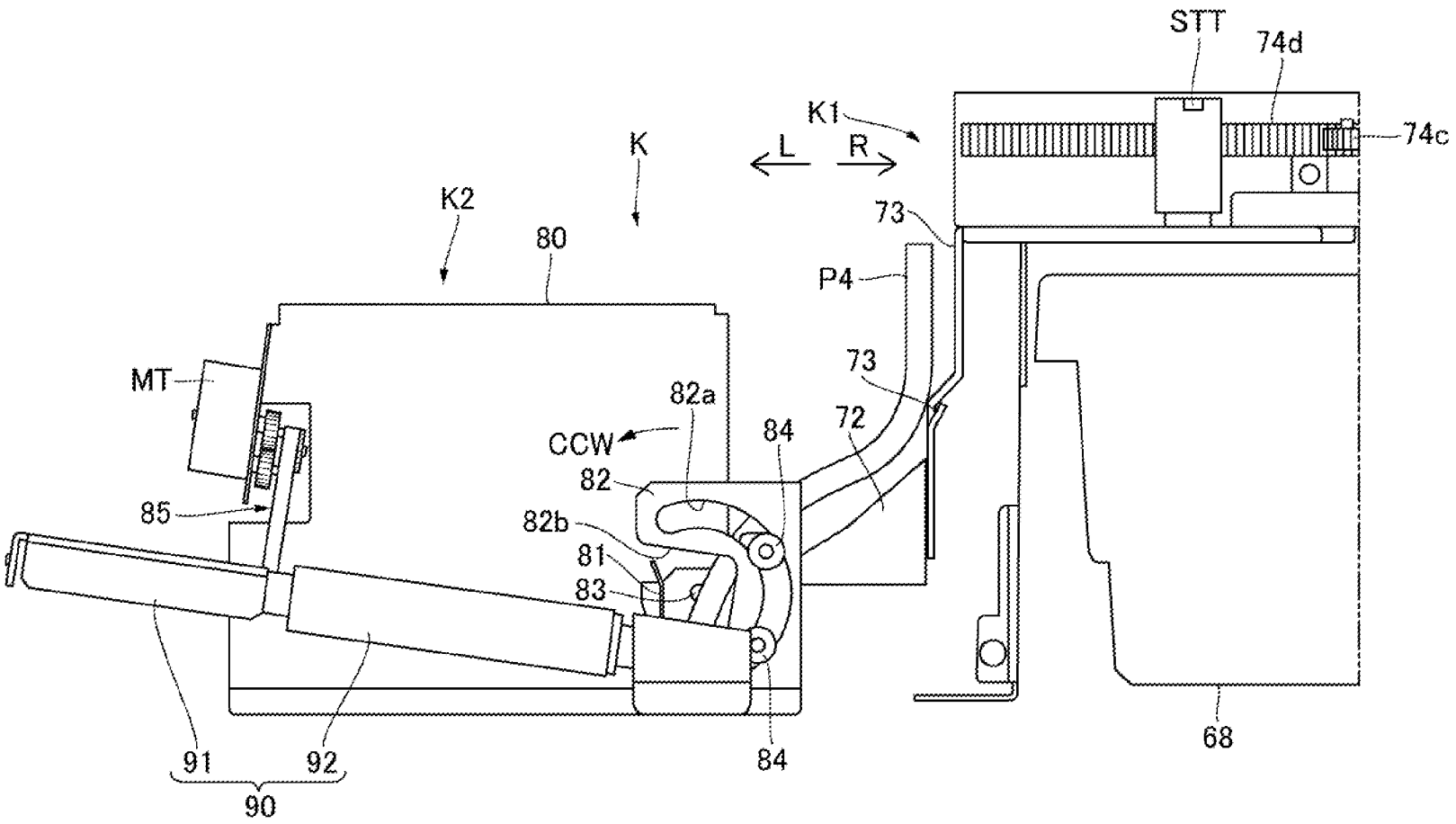
FIG. 9 is a view for illustrating a state in which the spine receiver of the sheet bundle discharging apparatus of FIG. 7 starts leftward rotation to discharge the booklet.

FIG. 9 is a view for illustrating a state in which the spine receiver 81 of the sheet bundle discharging apparatus K of FIG. 7 starts rotation in the CCW direction to discharge the booklet P4. At this time, the spine receiver 81 functions as an attitude changing unit configured to change an attitude of the booklet P4. That is, the spine receiver 81 changes an attitude of the booklet P4 from a state of a first attitude in which the booklet P4 is not placed on the conveyance belt 92 to a state of a second attitude in which the booklet P4 is placed on the conveyance belt 92.

Figure 10:
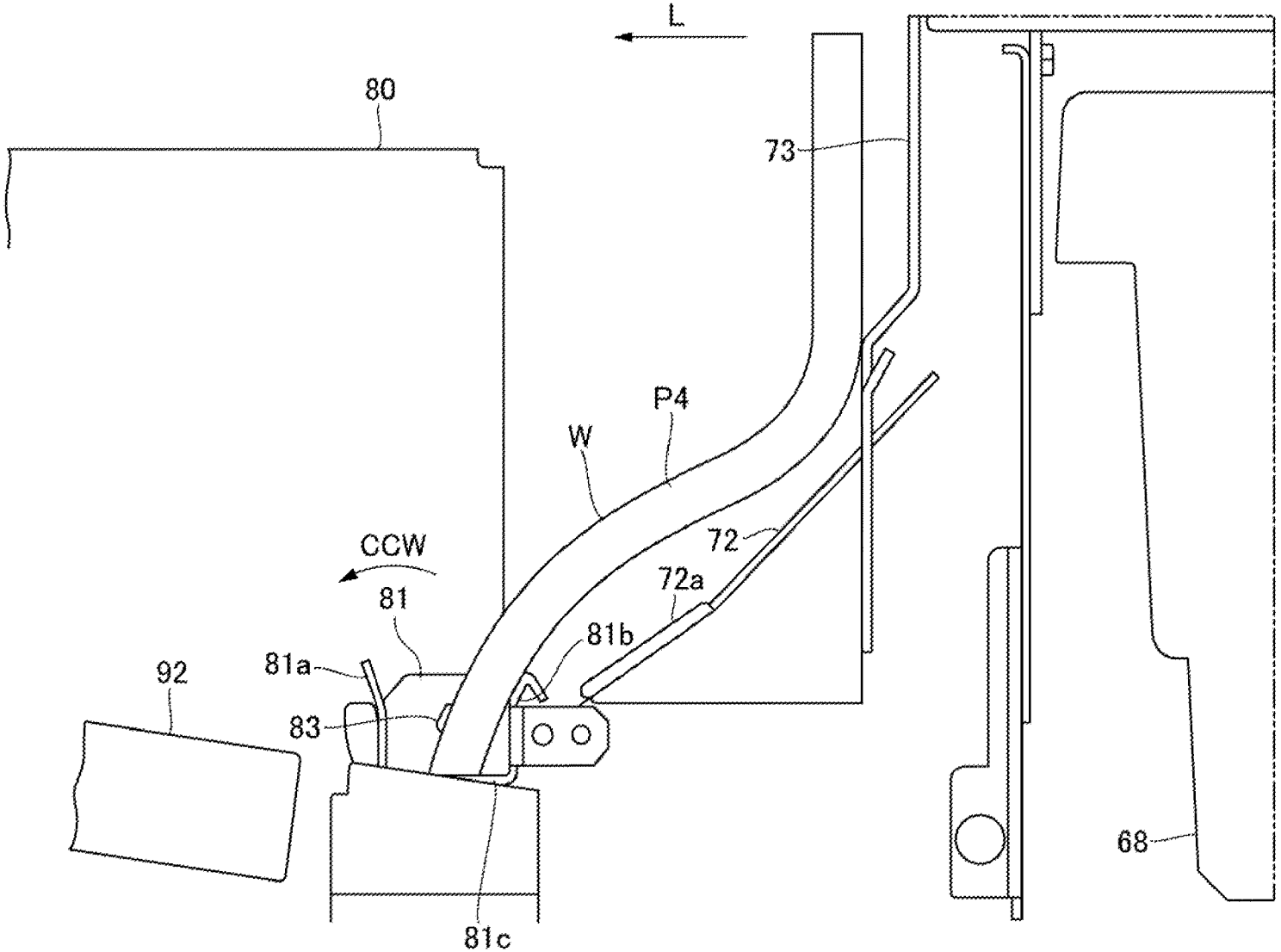
FIG. 10 is an enlarged view for illustrating a periphery of the spine receiver of FIG. 9.

FIG. 10 is an enlarged view for illustrating a periphery of the spine receiver 81 of FIG. 9. As illustrated in FIG. 9 and FIG. 10, a pair of guide shafts 84 are provided to the spine receiver 81. The pair of guide shafts 84 are engaged with a guide hole 82*a* formed in a guide plate 82 provided to the frame 80. The guide hole 82*a* is formed as an arc-shaped elongated hole, and a center thereof is aligned with a center of the support shaft 83. The spine receiver 81 rotates about the support shaft 83, and the pair of guide shafts 84 also rotate about the same position. The spine receiver 81 receives a rotary force form a discharge motor MT being a pulse motor through a rotary force transmitting mechanism (partially not shown) 85, and rotates from the booklet receiving position (waiting position) detected by the spine receiver home position sensor SHP (FIG. 6) to a discharge position for discharging the booklet.

Figure 11:
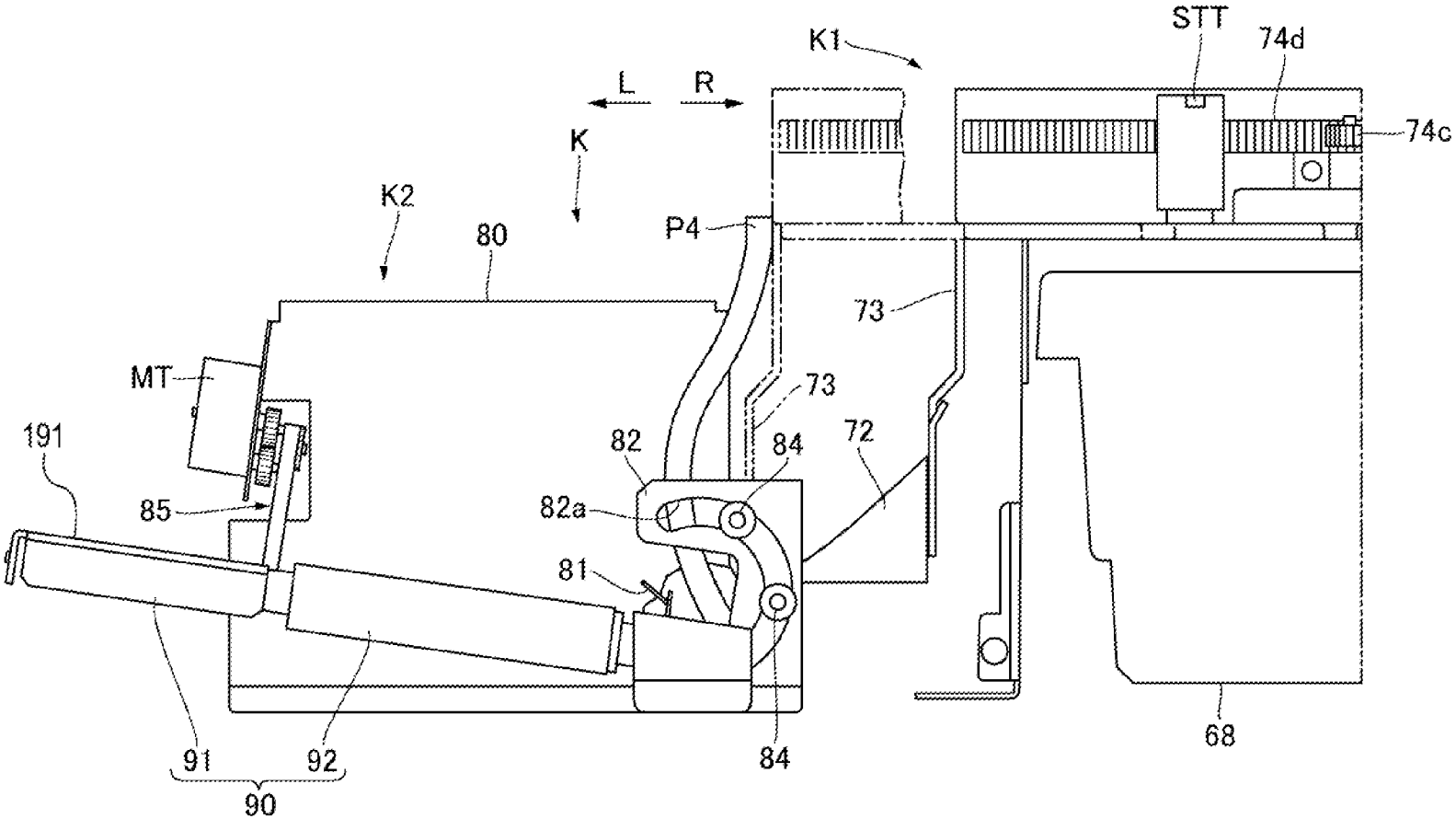
FIG. 11 is a view for illustrating a state in which the spine receiver further rotates leftward from the state of FIG. 7, and a pressing member presses the booklet in a conveyance direction (arrow L direction) in synchronization with the spine receiver.
Figure 12:
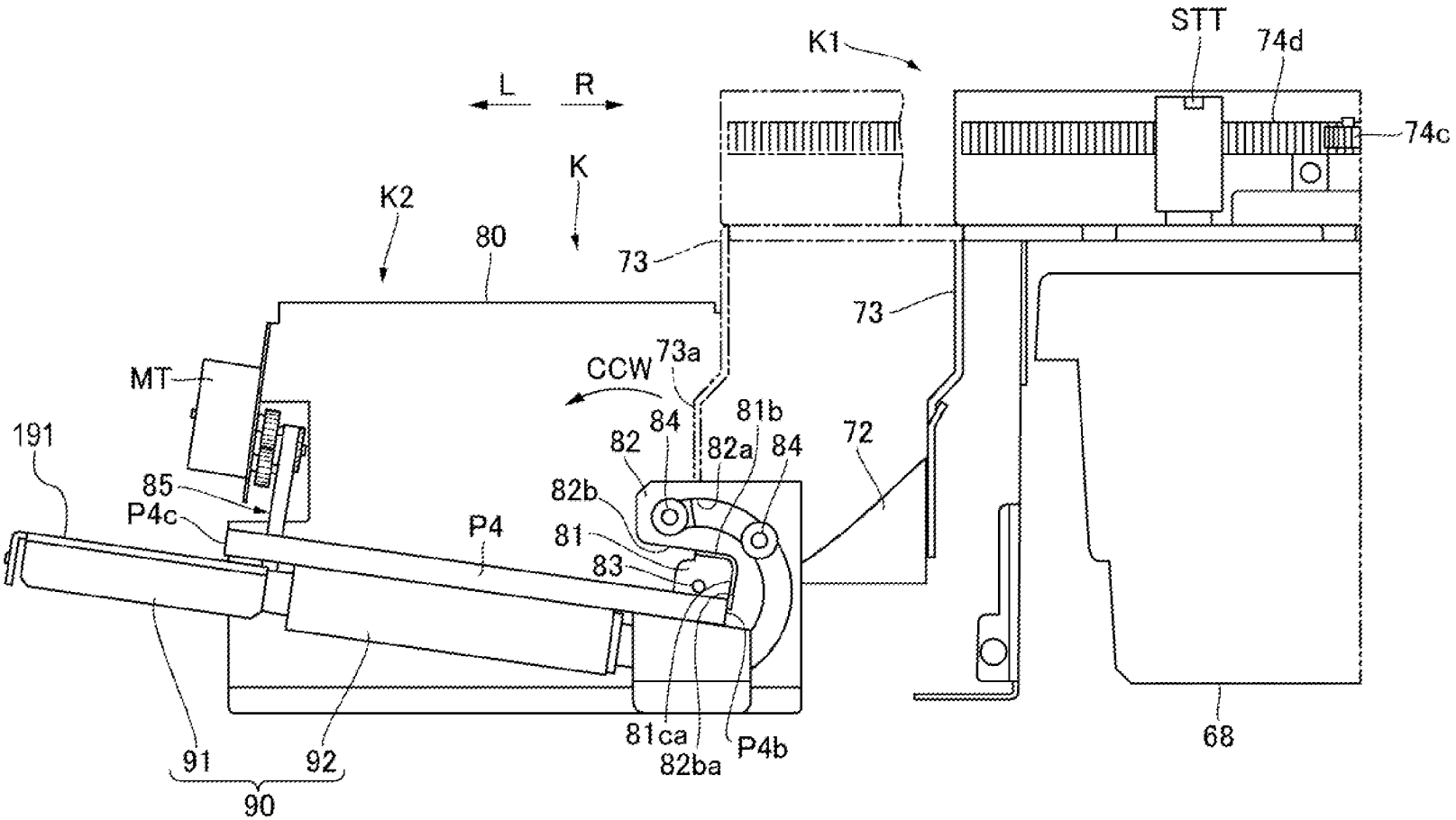
FIG. 12 is a view for illustrating a state in which the spine receiver further rotates leftward from the state of FIG. 11, and the pressing member further presses the booklet in the conveyance direction in synchronization with the spine receiver, thereby placing the booklet on a conveyance belt.

When the spine receiver 81 rotates to the discharge position, the booklet P4 is brought into the state illustrated in FIG. 11 and thereafter assumes the attitude of being placed on the conveyance belt 92 as illustrated in FIG. 12. At this time, the booklet P4 is placed on the conveyance belt 92 after the fore edge P4*c* passes through the conveyance belt 92 in a width direction of the conveyance belt 92 (direction perpendicular to the conveyance direction of the booklet P4).

Figure 16:
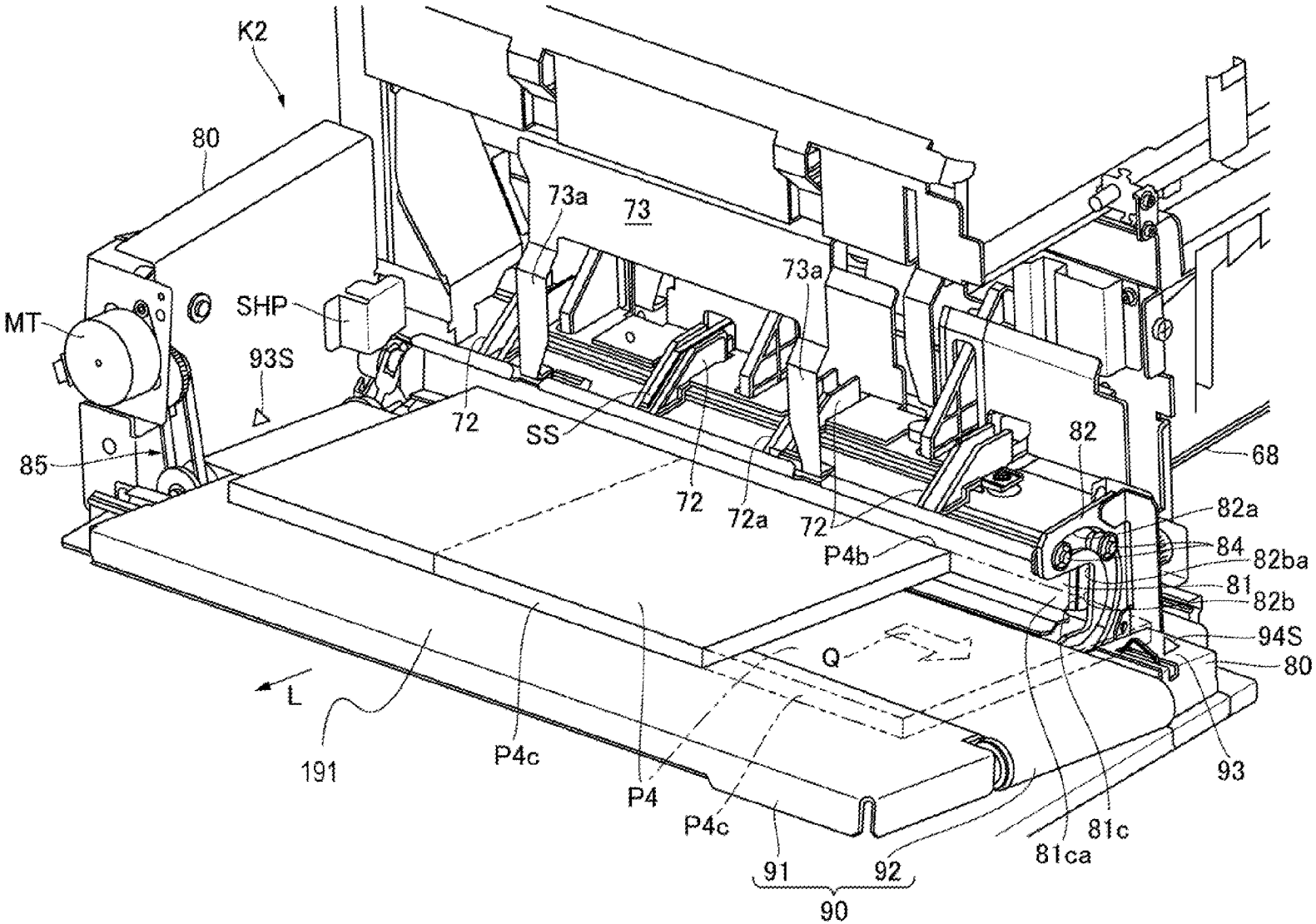
FIG. 16 is a perspective view for illustrating a state in which the conveyance belt delivers the booklet from the state of FIG. 12.

The guide plate 82 has a cutout 82*b* having a shape similar to a sectional shape of the spine receiver 81. As illustrated in FIG. 12 and FIG. 16, in a relative positional relationship between the guide plate 82 and the spine receiver 81, an orientation of the gutter-shaped opening of the spine receiver 81 having rotated in the arrow CCW direction is substantially the same as an orientation of the guide plate 82. In this case, it is preferred that a far edge 82*ba* of the cutout 82*b* (FIG. 16) be formed on the upstream side in the sheet bundle conveyance direction (arrow L direction) with respect to a booklet abutment surface (flat surface) 81*ca* formed on a gutter-shaped inner surface on which the spine receiver bottom plate 81*c* of the spine receiver 81 is brought into abutment against the spine P4*b* of the booklet P4.

When the cutout 82*b* is not formed, in a case in which the conveyance belt 92 is circulated while the booklet P4 remains being placed on the conveyance belt 92, the booklet P4 interferes with the guide plate 82, with the result that the booklet P4 cannot be discharged to the outside of the sheet bundle discharging apparatus K. Therefore, after the booklet P4 has been placed on the sheet bundle discharging portion 90, it is required that the conveyance belt 92 be rotated after the booklet P4 is transferred in the sheet bundle conveyance direction (arrow L direction) in FIG. 12 to the position of avoiding the guide plate 82. Therefore, the structure of the apparatus and control therefor becomes more complicated.

However, in the sheet bundle discharging apparatus according to this embodiment, the cutout 82*b* having the shape similar to the sectional shape of the spine receiver 81 is formed in the guide plate 82. Therefore, through rotation of the conveyance belt 92 while the booklet P4 remains being placed on the conveyance belt 92, the booklet P4 passes through the cutout 82*b* to be discharged. That is, the sheet bundle discharging apparatus according to this embodiment has a feature that the booklet P4 can be promptly discharged with the simple structure.

The discharge motor MT is configured to rotate the spine receiver 81, and serves also as a drive source for circulating the conveyance belt 92. The conveyance belt 92 and the spine receiver 81 are each connected to the discharge motor MT through intermediation of a one-way clutch (not shown). The conveyance belt 92 is driven by rotation of the discharge motor MT in a reverse direction, and the spine receiver 81 is connected to a link mechanism (not shown) configured to repeat swinging in the CCW direction and the CW direction in FIG. 8 through rotation of the discharge motor MT in a forward direction. Details of the conveyance belt 92 are described later.

Further, a clutch (not shown) may be provided between the discharge motor MT and the spine receiver 81 and between the discharge motor MT and the conveyance belt 92, to thereby achieve a configuration of selectively transmitting the rotation of the discharge motor MT to each of the spine receiver 81 and the conveyance belt 92.

As illustrated in FIG. 5 and FIG. 6, the slope 72 serving as guiding means is provided between the cutting scrap collecting container 68 and the spine receiver 81. The slope 72 is formed so that the spine receiver 81 side thereof has a downward slope. The slope 72 and the pressing member 73 are formed into a teeth shape with a gap therebetween so as to prevent interference with each other when the pressing member 73 moves.

FIG. 16 is a perspective view for illustrating a state in which the conveyance belt 92 delivers the booklet P4 from the bookbinding apparatus to the outside. As illustrated in FIG. 5 and FIG. 16, the sheet bundle discharging portion 90 is provided on the left side of the spine receiver 81. The sheet bundle discharging portion 90 includes, for example, a conveyor stay 91 and the conveyance belt 92. The conveyor stay 91 includes a receiving surface 191 and serves as a receiving member. The receiving surface 191 is configured to receive the fore edge P4*c* when the booklet P4 is placed on the conveyance belt 92. In this embodiment, the conveyor stay 91 is formed of a metal plate. The conveyance belt 92 of the sheet bundle discharging portion 90 is stretched around while being supported by the conveyor stay 91, and circulates in the arrow Q direction. The sheet bundle discharging portion 90 is provided in a substantially horizontal posture, but the spine receiver 81 side thereof is arranged so as to be slightly lower. As will be described later, the conveyance belt 92 is configured to discharge the booklet P4 placed by the spine receiver 81 to the outside of the apparatus.

The guide plate 82 has the cutout 82*b*, and the guide plate 82 is formed into the shape which is substantially the same as the sectional shape of the spine receiver 81. With this configuration, at the time of rotating the spine receiver 81 to the sheet bundle discharge position illustrated in FIG. 13 and thereafter discharging the booklet P4 with the conveyance belt 92, the booklet P4 can be discharged to the outside of the bookbinding apparatus with the spine receiver 81 serving as a guide.

Further, the guide plate 82 and the spine receiver 81 are formed so as to allow the booklet P4 to pass in the arrow Q direction. That is, the guide plate 82 has the cutout 82*b* at a portion for allowing the booklet P4 to pass, and the downstream end portion of the spine receiver 81 in the sheet bundle conveyance direction is formed into a shape being opened without an end surface. With this configuration, the booklet P4 placed on the conveyance belt 92 can be conveyed in the arrow Q direction and discharged without allowing the booklet P4 to move in the direction of the arrow L in FIG. 16.

FIG. 18 is a control block diagram for illustrating the image forming system in this embodiment. As illustrated in FIG. 18, the image forming apparatus controller 101 is provided to the image forming apparatus A. The image forming apparatus controller 101 controls, for example, the sheet supply portion 2, the image forming portion 3, the original feeder 25, and the scanner unit 20 based on image formation information input to the operation panel 18 by a user, to thereby allow the image forming apparatus A to perform an image forming operation. The bookbinding apparatus controller 102 is provided to the bookbinding apparatus B. The bookbinding apparatus controller 102 controls rotation of the motors through detection operations of the sensors to control, for example, the stacking portion 40, the adhesive applying portion 55, the cover binding portion 60, the cutting portion 65, and the sheet bundle discharging apparatus K, to thereby allow the bookbinding apparatus B to perform a bookbinding operation. A post-processing apparatus controller 103 is provided to the post-processing apparatus C. The post-processing apparatus controller 103 controls the post-processing apparatus C to perform at least one post-processing such as stapling, punching, or stamping on sheets having been subjected to image formation. The image forming apparatus controller 101, the bookbinding apparatus controller 102, and the post-processing apparatus controller 103 may be integrated and provided at any location in the image forming system D.

(Description of Booklet Discharging Operation)

Figure 17:
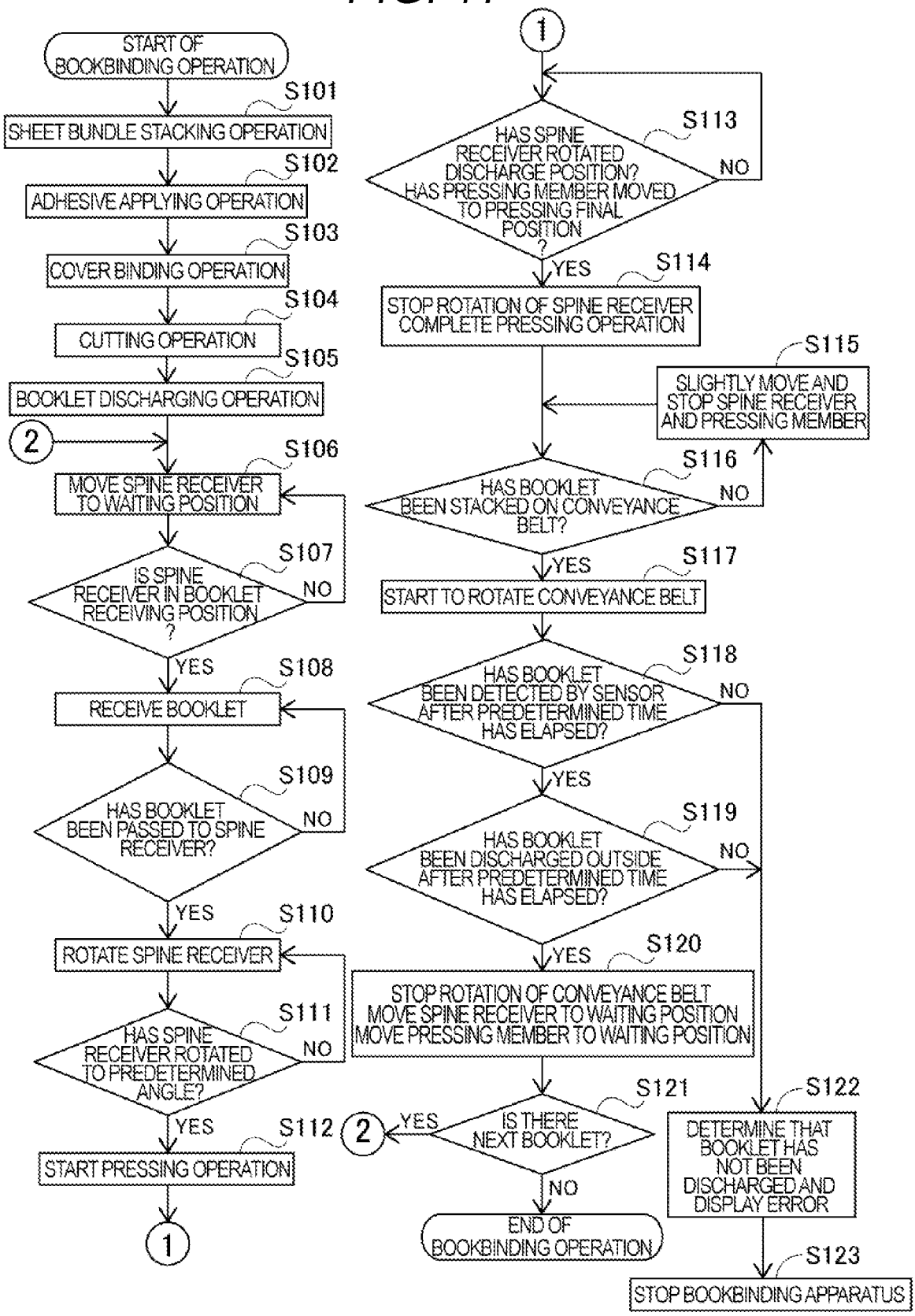
FIG. 17 is a flowchart for illustrating a bookbinding operation of the bookbinding apparatus according to the embodiment.

FIG. 17 is a flowchart for illustrating the bookbinding operation of the bookbinding apparatus B according to this embodiment. The flowchart is stored in a storage (not shown) of the bookbinding apparatus controller 102 in FIG. 1 and FIG. 18. The bookbinding apparatus controller 102 performs operation control for the bookbinding apparatus B based on the flowchart. On this occasion, the bookbinding apparatus controller 102 performs communication of information required for bookbinding with the image forming apparatus controller 101 and the post-processing apparatus controller 103.

Description is made of processing of Step S101 to Step S123 in FIG. 17. As illustrated in FIG. 2 and FIG. 17, the inner sheet bundle having been stacked in the stacking portion 40 (FIG. 17, Step S101) is formed into the sheet bundle covered with the cover by the adhesive applying portion 55 and the cover binding portion 60 (Step S102 and Step S103). After that, the sheet bundle is subjected to trim-cutting in the cutting portion 65 to be formed into the booklet (Step S104). The sheet bundle discharging roller pair 66 starts the operation of discharging the booklet to the sheet bundle discharging portion K2 of the sheet bundle discharging apparatus K (Step S105). As illustrated in FIG. 5, at the time of receiving the booklet, it is required that the sheet bundle discharging portion K2 rotate the spine receiver 81 to the booklet receiving position (waiting position). Therefore, the bookbinding apparatus controller 102 allows the discharge motor MT to rotate, to thereby slightly rotate the spine receiver 81 in the rightward direction (FIG. 8, CW direction) (Step S106). The bookbinding apparatus controller 102 stops the discharge motor MT at the waiting position at which the spine receiver 81 is detected by the spine receiver home position sensor SHP (FIG. 6) (YES in Step S107).

Then, when it is determined by the spine receiver home position sensor SHP that the spine receiver 81 is at the home position (waiting position), the booklet from the sheet bundle discharging roller pair 66 is guided to the receiving discharging guide 71 (FIG. 5), and is slipped to the spine receiver 81 with the slope 72 serving as a guide. As illustrated in FIG. 7 and FIG. 8, the spine P4*b* of the booklet P4 is brought into abutment against the spine receiver 81 (Step S108). The bookbinding apparatus controller 102 determines whether or not the booklet has been passed to the spine receiver 81 based on a detection operation of the slope sensor SS illustrated in FIG. 6. When the booklet has been passed to the spine receiver 81 (YES in Step S109), the bookbinding apparatus controller 102 allows the discharge motor MT to reversely rotate, to thereby rotate the spine receiver 81 leftward in the CCW direction in FIG. 8 (Step S110). When the bookbinding apparatus controller 102 detects that a predetermined time has elapsed from start of rotation of the spine receiver 81 from the home position (or detects that the spine receiver 81 has rotated leftward to a predetermined angle) based on a pulse emitted from the discharge motor MT (YES in Step S111), the bookbinding apparatus controller 102 allows the pressing member motor MP (FIG. 5) to rotate, thereby allowing the pressing member 73 to start moving in the leftward direction (L direction) in FIG. 5. That is, the pressing member 73 starts operation after the start of rotation of the spine receiver 81. The pressing member 73 is located on the upstream side with respect to the spine receiver 81. The pressing member 73 operates in synchronization with the spine receiver 81. In order to place the booklet P4 on the conveyance belt 92, the pressing member 73 presses (acts on) the booklet P4 at a position on the upstream side with respect to the spine receiver 81 (Step S112). FIG. 11 is an illustration of this state. FIG. 11 is a view for illustrating a state in which the spine receiver 81 further rotates leftward from the state of FIG. 7, and the pressing member 73 presses the booklet P4 in the discharging conveyance direction (arrow L direction) in synchronization with the spine receiver 81. That is, the pressing member 73 also serves as the attitude changing unit configured to change an attitude of the booklet P4.

Figure 13:
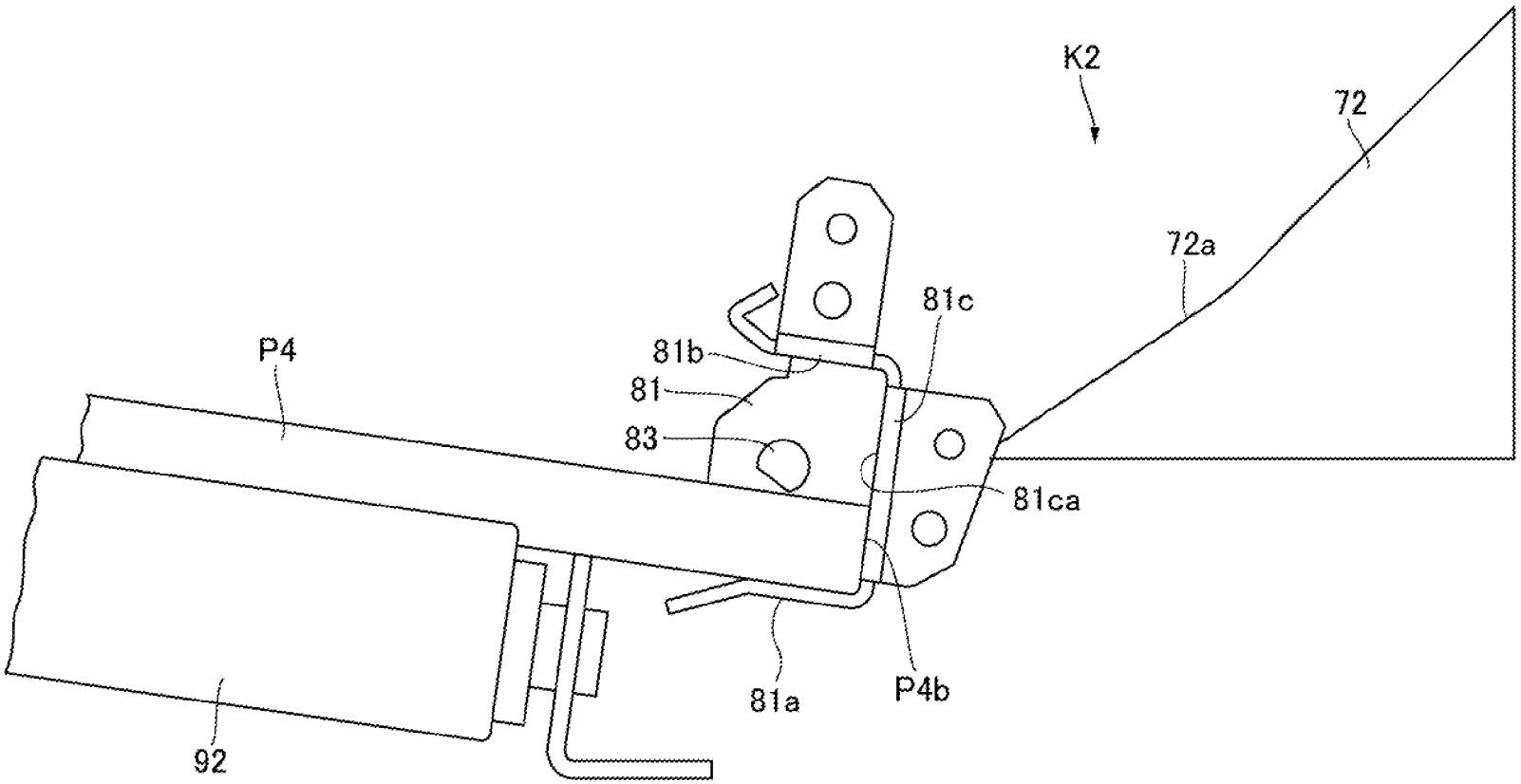
FIG. 13 is an enlarged view for illustrating a periphery of the spine receiver of FIG. 12.

FIG. 12 is a view for illustrating a state in which the spine receiver 81 further rotates leftward from the state of FIG. 11, and the pressing member 73 further presses the booklet P4 in the conveyance direction (arrow L direction) in synchronization with the spine receiver 81, thereby placing the booklet P4 on the conveyance belt 92. FIG. 13 is an enlarged view for illustrating a periphery of the spine receiver 81 of FIG. 12. As illustrated in FIG. 12, FIG. 13, and FIG. 18, the bookbinding apparatus controller 102 detects that the spine receiver 81 has rotated the booklet leftward to the discharge position with respect to the conveyance belt 92 based on a pulse emitted from the discharge motor MT. When it is detected by the pressing position sensor STT that the pressing member 73 has moved to a pressing final position (YES in Step S113), the bookbinding apparatus controller 102 stops rotation of the discharge motor MT and the pressing member motor MP (Step S114). After the rotation of the discharge motor MT and the pressing member motor MP has been stopped, when it is determined by a booklet placement sensor 93S (FIG. 16) that the booklet is placed on the conveyance belt 92 (YES in Step S116), the bookbinding apparatus controller 102 allows the discharge motor MT to rotate, to thereby circulate the conveyance belt 92 (Step S117). The booklet placement sensor 93S is provided to the frame 80 near the conveyance belt 92 as illustrated in FIG. 16. In the processing of Step S115, when the booklet is not detected by the booklet placement sensor 93S (NO in Step S116), the bookbinding apparatus controller 102 repeats the operation of slightly moving and stopping the spine receiver 81 and the pressing member 73 until the booklet is detected (until YES is given in Step S116).

The booklet placement sensor 93S may be omitted, and circulation of the conveyance belt 92 may be start at a timing after elapse of a predetermined time from the stop of rotation of the pressing member motor MP.

It is preferred that a position at which the pressing member 73 presses the booklet, that is, a position of the pressing member 73 projecting toward the booklet side be located at a plurality of positions including a part below the center in the height direction of the booklet and distributed at substantially equal distances from the center in the width direction of the booklet P4. With such positions, the booklet P4 is stabilized in behavior at the time of being placed on the conveyance belt 92, thereby being capable of reducing variation in position of the booklet P4 on the conveyance belt 92.

When a predetermined time has elapsed after circulation of the conveyance belt 92, and the booklet is detected by the booklet discharge sensor 94S (FIG. 16), the bookbinding apparatus controller 102 determines that the booklet has started being discharged (YES in Step S118). Further, when a predetermined time has elapsed, and the booklet is not detected by the booklet discharge sensor 94S (YES in Step S119), the bookbinding apparatus controller 102 determines that the booklet has been conveyed in the arrow Q direction and discharged to the outside of the sheet bundle discharging portion K2 (Step S120). The booklet discharge sensor 94S is provided on the frame 80 near a terminal end of the conveyance belt 92 as illustrated in FIG. 16. When the booklet has been discharged, the bookbinding apparatus controller 102 stops the conveyance belt 92, allows the discharge motor MT to return the spine receiver 81 to the waiting position, and allows the pressing member motor MP to return the pressing member 73 to the waiting position at which the pressing member 73 is detected by the pressing member home position sensor STH (FIG. 5). When the next booklet is present (YES in Step S121), the bookbinding apparatus controller 102 returns to the processing of Step S106, repeats the same control until the booklet becomes absent, and terminates the series of booklet discharging at the time point at which the booklet is absent (NO in Step S121).

When the booklet is not detected by the booklet discharge sensor 94S in the processing of Step S118 (NO in Step S118), or when the booklet remains being detected by the booklet discharge sensor 94S in the processing of Step S119 (NO in Step S119), the bookbinding apparatus controller 102 determines that the booklet is not placed at a predetermined position on the conveyance belt 92. Then, in the aim of preventing booklet jamming, the bookbinding apparatus controller 102 allows the operation panel 18 to display error (Step S122), and stops the conveyance belt 92 (Step S123).

(Detailed Description of Discharging Operation)

Among the processing of Step S101 to Step S123 in FIG. 17 described above, detailed description is made below with regard to the processing of Step S106 to Step S115, Step S108, and the processing of Step S119 to Step S123.

FIG. 7 and FIG. 8 are views for illustrating the state in which the spine receiver 81 has received the booklet in the processing of Step S106, Step S107, and Step S108. As illustrated in FIG. 7 and FIG. 8, the spine receiver lower guide 81*b* of the spine receiver 81 is located substantially in parallel to a slope inclination surface 72*a* of the slope 72, and is located so as not to project upward (toward the booklet side) with respect to the slope inclination surface 72*a*. With this, the booklet P4 having been conveyed is brought into abutment against the spine receiver bottom plate 81*c* of the spine receiver 81 without being caught by the spine receiver 81. Further, the spine receiver bottom plate 81*c* is formed so as to be substantially perpendicular to the spine receiver lower guide 81*b*. Thus, when the spine receiver bottom plate 81*c* and the spine P4*b* of the booklet P4 are brought into abutment against each other, the attitude of the booklet P4 is stabilized.

FIG. 9 and FIG. 10 are views for illustrating the state in which, after the spine receiver 81 and the booklet P4 have been brought into abutment against each other, the discharge motor MT (FIG. 7) has rotated the spine receiver 81 in the counterclockwise direction (arrow CCW direction) in the processing of Step S110 and Step S111. In the processing of Step S110 and Step S111, the spine receiver 81 rotates in the counterclockwise direction (arrow CCW direction) by a predetermined angle, to thereby change the booklet into an attitude of being curved. That is, a distal end of the spine receiver lower guide 81*b* presses the booklet, and hence, as indicated by the reference symbol Win FIG. 10, a lower half portion of the booklet P4 is curved toward the rotation direction side of the spine receiver 81.

FIG. 11 is a view for illustrating the state of the spine receiver 81 and the pressing member 73 in the processing of Step S111 to Step S114. When the lower half portion of the booklet is curved as illustrated in FIG. 10, the pressing member motor MP (FIG. 5) rotates to move the pressing member 73 in the arrow L direction in FIG. 11 and bring the pressing member 73 into abutment against the booklet. A position of the pressing member 73 is determined by the pressing member home position sensor STH (FIG. 5) and the pressing position sensor STT. When the spine receiver 81 receives the booklet, the pressing member 73 waits at the waiting position in FIG. 5 and FIG. 7 at which the pressing member 73 is detected by the pressing member home position sensor STH. Then, when the lower half portion of the booklet is curved as illustrated in FIG. 10, the pressing member 73 is brought into abutment against the booklet (FIG. 11) while moving to a pressing operation completion position of FIG. 12 at which the pressing member 73 is detected by the pressing position sensor STT, and places the booklet on the conveyance belt 92.

In the description above, as illustrated in FIG. 9 to FIG. 12, the sheet bundle discharging portion K2 allows the booklet P4 to be curved through the rotating operation of the spine receiver 81, and then starts the pressing operation on the booklet P4 by the pressing member 73, thereby placing the booklet P4 on the conveyance belt 92. Such operation is performed in order to stabilize an attitude of the booklet when a booklet having a low stiffness or a large-sized booklet which has not been subjected to trim-cutting is to be placed.

Then, when the attitude of the booklet P4 is changed from the first attitude illustrated in FIG. 7 to the second attitude illustrated in FIG. 12, the fore edge P4*c* of the booklet P4 passes through a region in which the conveyance belt 92 is provided in a belt width direction perpendicular to the conveyance direction of the conveyance belt 92, and thereafter arrives at a region in which the receiving surface 191 of the conveyor stay 91 is provided.

Figure 14:
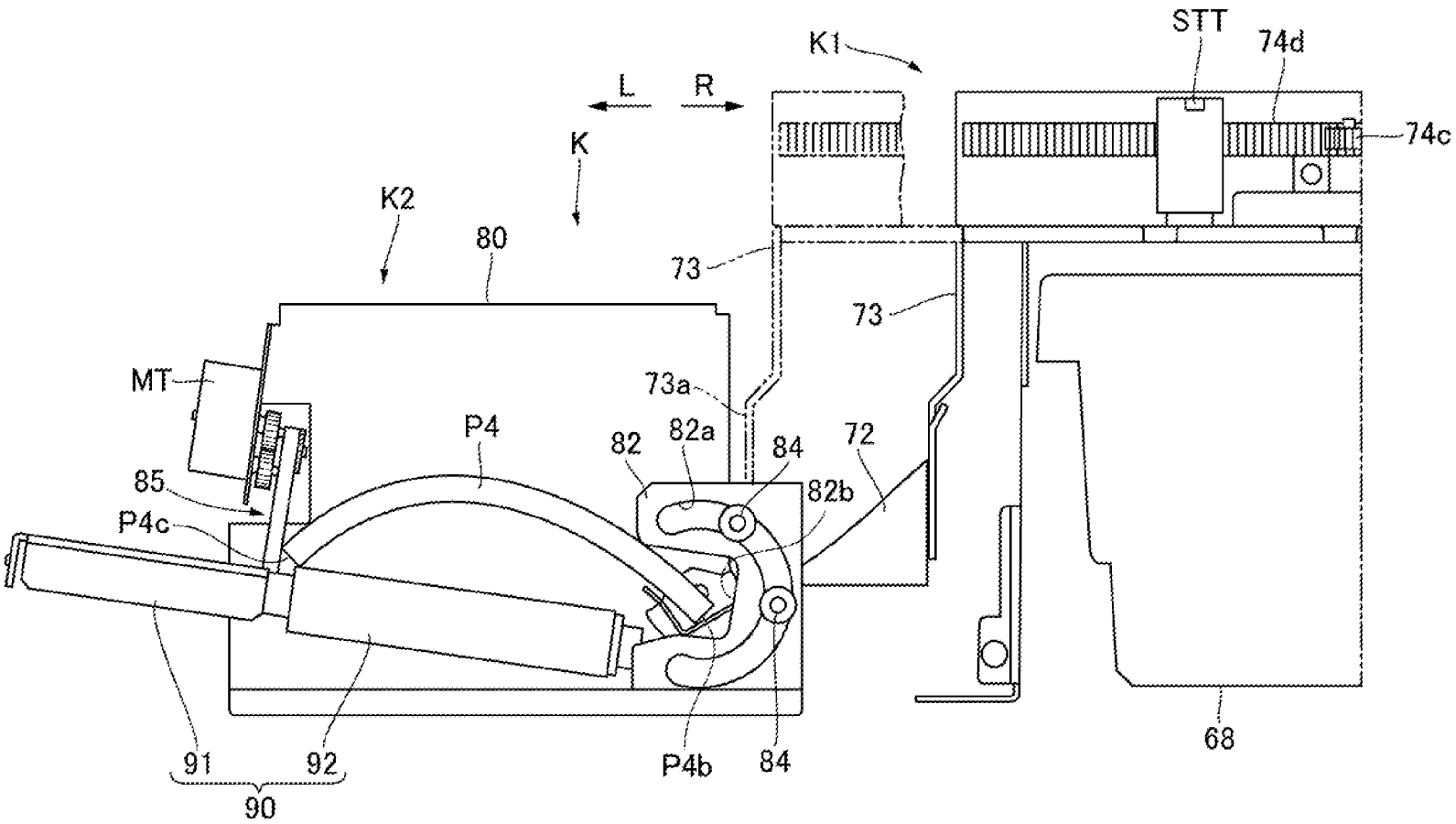
FIG. 14 is a view for illustrating a state in which, in the sheet bundle discharging apparatus of FIG. 7, when the rotating operation of the spine receiver is not performed, or when the rotating operation of the spine receiver and the pressing operation of the pressing member are not synchronized with each other, the booklet is curled on the conveyance belt.

As illustrated in FIG. 14, when the operations of the spine receiver 81 and the pressing member 73 are not synchronized, in a course of changing the attitude of the booklet P4 and placing the booklet P4 on the conveyance belt 92, the fore edge P4*c* side (opposed side of the spine P4*b*) of the booklet P4 precedes. Then, when the fore edge P4*c* of the booklet precedes to be brought into abutment against the conveyance belt 92, the booklet P4 is curled on the conveyance belt 92, and there is a risk of causing booklet jamming or causing a hitting mark or damage on the booklet surface. However, the stiffness and the size of the booklet are selected by a user, and hence what kind of the booklet is to be conveyed to the sheet bundle discharging portion 90 is unknown. Therefore, in order to place the booklet on the conveyance belt 92 irrespective of a kind of the booklet to be conveyed, the sheet bundle discharging portion K2 according to this embodiment synchronizes the rotating operation of the spine receiver 81 and the pressing operation of the pressing member 73 to suppress occurrence of the booklet jamming and occurrence of the hitting mark and damage on the booklet surface.

Figure 15:
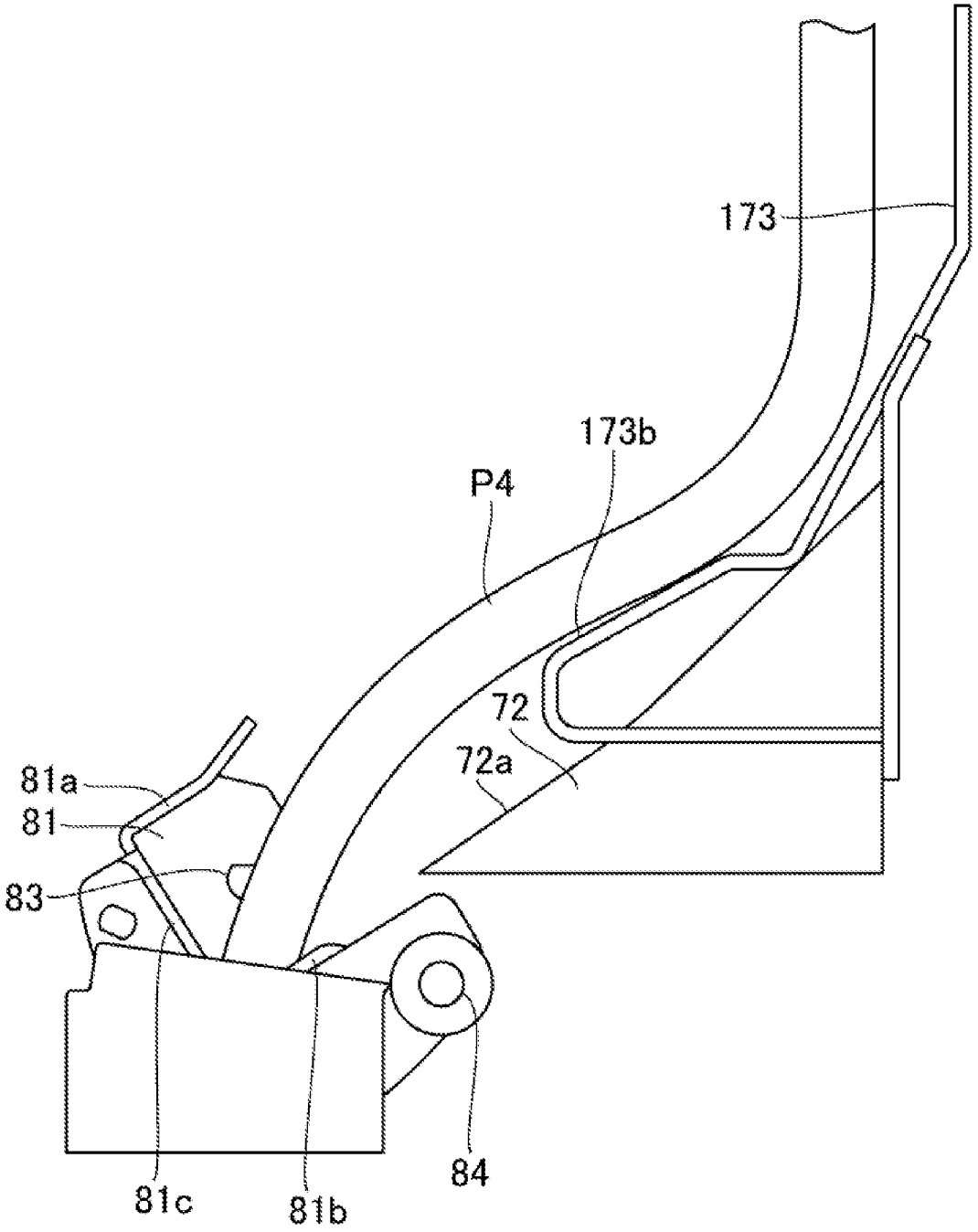
FIG. 15 is a view for illustrating an example in which, in the sheet bundle discharging apparatus of FIG. 7, the booklet is curved by the pressing member before the booklet is placed on the conveyance belt.

When the rotating operation of the spine receiver 81 and the pressing operation of the pressing member 73 are started at the same time without synchronization, the attitude of the booklet before placement on the conveyance belt 92 is important. For example, as illustrated in FIG. 15, it is required that a projecting portion 173*b* projecting toward the conveyance belt 92 side be formed at a part of the pressing member 173 and that the shape of the booklet be curved with the projecting portion 173*b*. FIG. 15 is a view for illustrating an example in which, in the sheet bundle discharging apparatus K of FIG. 7, the booklet P4 is curved with the pressing member 173 before the booklet P4 is placed on the conveyance belt 92.

However, the booklet may be, for example, a booklet having high stiffness and a booklet having a small size which has been subjected to trim-cutting by the cutting portion 65. Such booklets are less liable to be curved at the fore edge of the booklet on the conveyance belt 92. Therefore, the sheet bundle discharging portion K2 may place the booklet on the conveyance belt 92 only through the pressing operation of the pressing member 73 without rotation of the spine receiver 81. Further, the booklet may be placed on the conveyance belt 92 only through the rotating operation of the spine receiver 81. Further, the rotating operation of the spine receiver 81 and the pressing operation of the pressing member 73 may be driven at the same time without synchronization, or the operation speed of the pressing member 73 may be changed. For example, the booklet can be brought into the attitude illustrated in FIG. 9 or FIG. 10 by starting the rotating operation of the spine receiver 81 and the pressing operation of the pressing member 73 at the same time and setting the operation speed of the pressing member 73 to be slower. That is, through suitable selection of the content of the operation of the spine receiver 81, the timing of starting the operation of the pressing member 73, and the operation speed of the pressing member 73 in accordance with the stiffness and the size of the booklet, damage on the booklet can be reduced at the time of placing the booklet P4 on the conveyance belt 92.

FIG. 12 and FIG. 13 are views for illustrating the state corresponding to the processing of Step S114 and Step S115 in which the rotating operation of the spine receiver 81 and the pressing operation of the pressing member 73 have been terminated. At this time, the booklet P4 is placed on the conveyance belt 92. When the spine receiver 81 has terminated its rotating operation, and the booklet P4 is placed on the conveyance belt 92, the spine receiver upper guide 81*a* is brought into a state of being substantially parallel to an angle of the conveyor stay 91, and is located at a position of not projecting toward the booklet side with respect to the conveyor stay 91. As a result, as illustrated in FIG. 16, when the conveyance belt 92 conveys the booklet in the arrow Q direction to discharge the booklet toward the near side of the bookbinding apparatus, the surface of the booklet is not rubbed against the spine receiver upper guide 81*a*, thereby being capable of preventing damage on the cover.

As illustrated in FIG. 12 and FIG. 16, the sheet bundle discharging portion 90 is inclined so that the spine P4*b* of the booklet P4 placed on the conveyance belt 92 becomes lower than the fore edge P4*c*. That is, the sheet bundle discharging portion 90 is arranged so as to be inclined in a direction of reducing an angle of change in attitude of the sheet bundle with respect to a horizontal direction. Such configuration is given in order to reduce a force given at the time of placing a booklet with a smooth cover on the conveyance belt 92 by the rotating operation of the spine receiver 81 and the pressing operation of the pressing member 73. That is, such configuration is given to prevent slipping of the booklet on the sheet bundle discharging portion 90 in the arrow L direction in FIG. 12 and FIG. 16.

Figure 19:
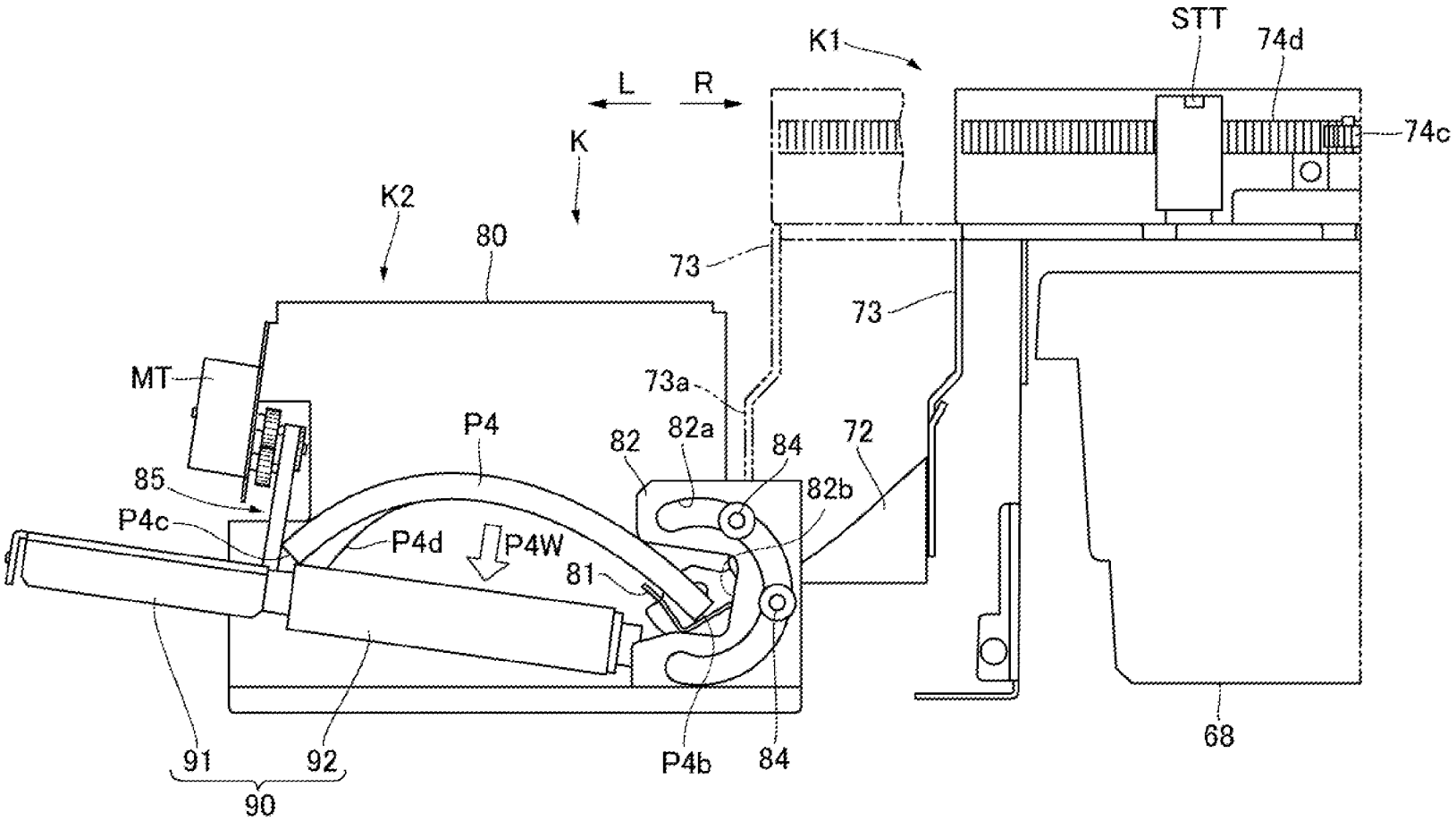
FIG. 19 is a view for illustrating a state in which a fore edge of the booklet is caught on the conveyance belt.

As described above with reference to FIG. 14, when the booklet P4 is to be placed on the conveyance belt 92, the fore edge P4*c* side (opposed side of the spine P4*b*) of the booklet P4 may precede. In this case, the booklet P4 is curled (curved) on the conveyance belt 92. As illustrated in FIG. 19, when the booklet P4 is placed on the conveyance belt 92 under the state in which the fore edge P4*c* of the booklet P4 precedes, there is a risk in that the sheet P4*d* is bent or damaged.

Figure 21:
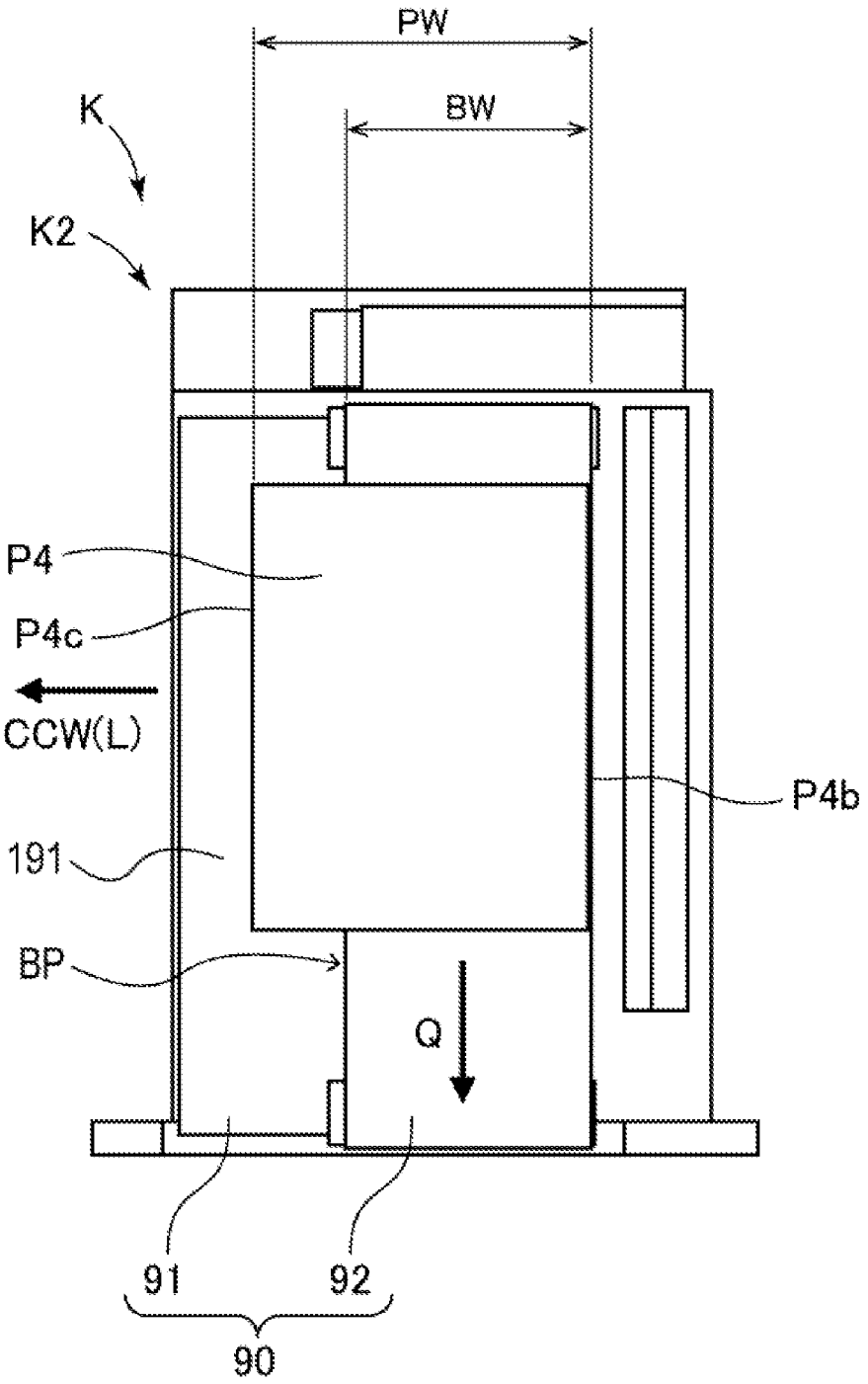
FIG. 21 is a view for illustrating main parts of the sheet bundle discharging apparatus according to the embodiment as seen from a direction perpendicular to a conveyance belt surface.

With reference to FIG. 21, description is made of the case in which the fore edge P4*c* of the booklet P4 precedes. In this embodiment, even when the booklet P4 is placed on the conveyance belt 92 under the state in which the fore edge P4*c* of the booklet P4 precedes, bending or damage on the fore edge P4*c* can be suppressed.

The sheet bundle discharging portion 90 includes the conveyor 91, which includes the conveyance belt 92 and the receiving surface 191. The conveyance belt 92 is arranged between the receiving surface 191 and the spine receiver 81 serving as the attitude changing unit. At a boundary portion BP between the receiving surface 191 and the conveyance belt 92, the receiving surface 191 is arranged at a position lower than the conveyance belt 92. Further, a friction coefficient between the receiving surface 191 and the booklet P4 is set smaller than a friction coefficient between the conveyance belt 92 and the booklet P4.

A width of the conveyance belt 92 is set so that a friction resistance required for conveyance of the booklet P4 can be obtained. That is, a width BW of the conveyance belt 92 (length of the conveyance belt 92 in a direction perpendicular to the discharging direction Q) is equal to or larger than a half of a width PW of the booklet P4 (length of the booklet P4 in a direction perpendicular to the discharging direction Q) and is set to be smaller than the width PW of the booklet. That is, the relationship of $\frac{1}{2}\times PW \leq BW < PW$ is satisfied. With the width BW of the conveyance belt 92 set in such a manner, the booklet P4 can be stably conveyed. It is preferred that the width BW of the conveyance belt be set with a maximum width as a reference among various widths of the booklet which enable the bookbinding apparatus B to perform bookbinding.

When the booklet P4 is placed on the conveyance belt 92 by the spine receiver 81 and the pressing member 73, the fore edge P4*c* moves in the arrow CCW direction in FIG. 12 and FIG. 21. The receiving surface 191 receives the fore edge P4*c* which moves in the arrow CCW direction.

However, when the booklet P4 having a high stiffness is placed on the conveyance belt 92 without being bent, the fore edge P4*c* of the booklet P4 is not brought into contact with the receiving surface 191. This is because, at the boundary portion BP between the receiving surface 191 and the conveyance belt 92, the receiving surface 191 is located below the conveyance belt 92. When the booklet P4 having a high stiffness is placed on the conveyance belt 92, the fore edge P4*c* of the booklet P4 is conveyed in a state of floating above the receiving surface 191.

Moreover, when the booklet P4 having a width PW narrower than the width BW of the conveyance belt 92 is placed on the conveyance belt 92, the fore edge P4*c* of the booklet P4 does not reach the region in which the receiving surface 191 is provided. Therefore, the fore edge P4*c* of the booklet P4 is conveyed without being brought into contact with the receiving surface 191.

In the sheet bundle discharging portion 90 having such a configuration, the fore edge P4*c* of the moving booklet is brought into abutment against the receiving surface 191 having a friction coefficient smaller than that of the conveyance belt 92. The fore edge P4*c* of the booklet P4 slips on the receiving surface 191, thereby being capable of suppressing bending and damage on the fore edge P4*c*. Further, when the width BW of the conveyance belt 92 is set to be equal to or larger than a half of the width PW of the booklet (PW/2) and smaller than the width PW of the booklet, a contact area between the conveyance belt 92 and the booklet P4 becomes larger than a contact surface between the receiving surface 191 and the booklet P4. Therefore, the conveyance belt 92 can convey and discharge the booklet P4 in a stable attitude with a friction force. Further, the surface of the receiving surface 191 is arranged at a position lower than the surface of the conveyance belt 92, thereby being capable of reducing a friction resistance received from the receiving surface 191 by the booklet P4 placed on the conveyance belt 92. Therefore, the conveyance belt 92 can smoothly discharge the booklet P4.

Figure 20:
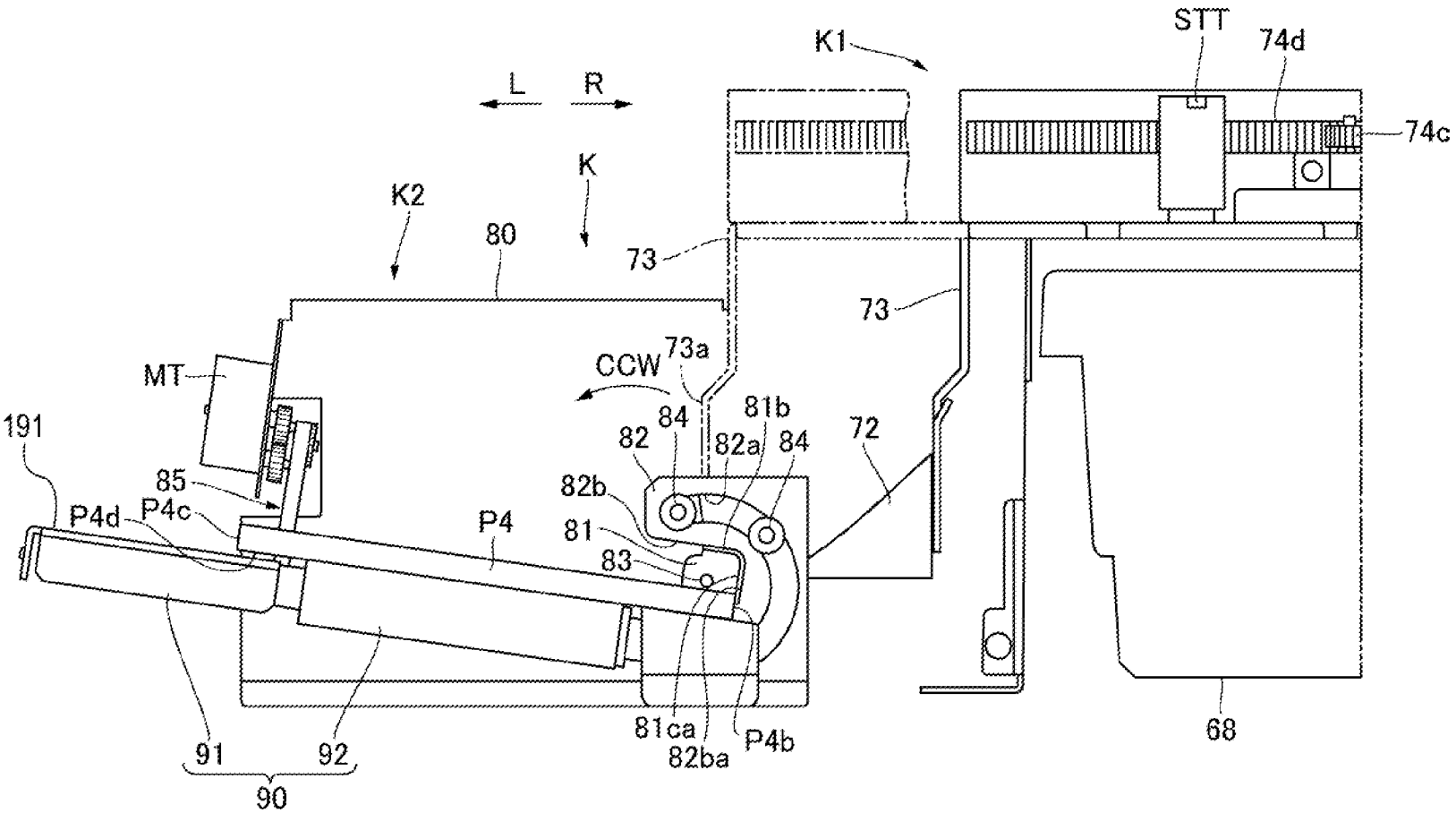
FIG. 20 is a view for illustrating a state in which a cover or an inner sheet at the fore edge of the booklet is sandwiched between the booklet and the conveyance belt.
Figure 22:
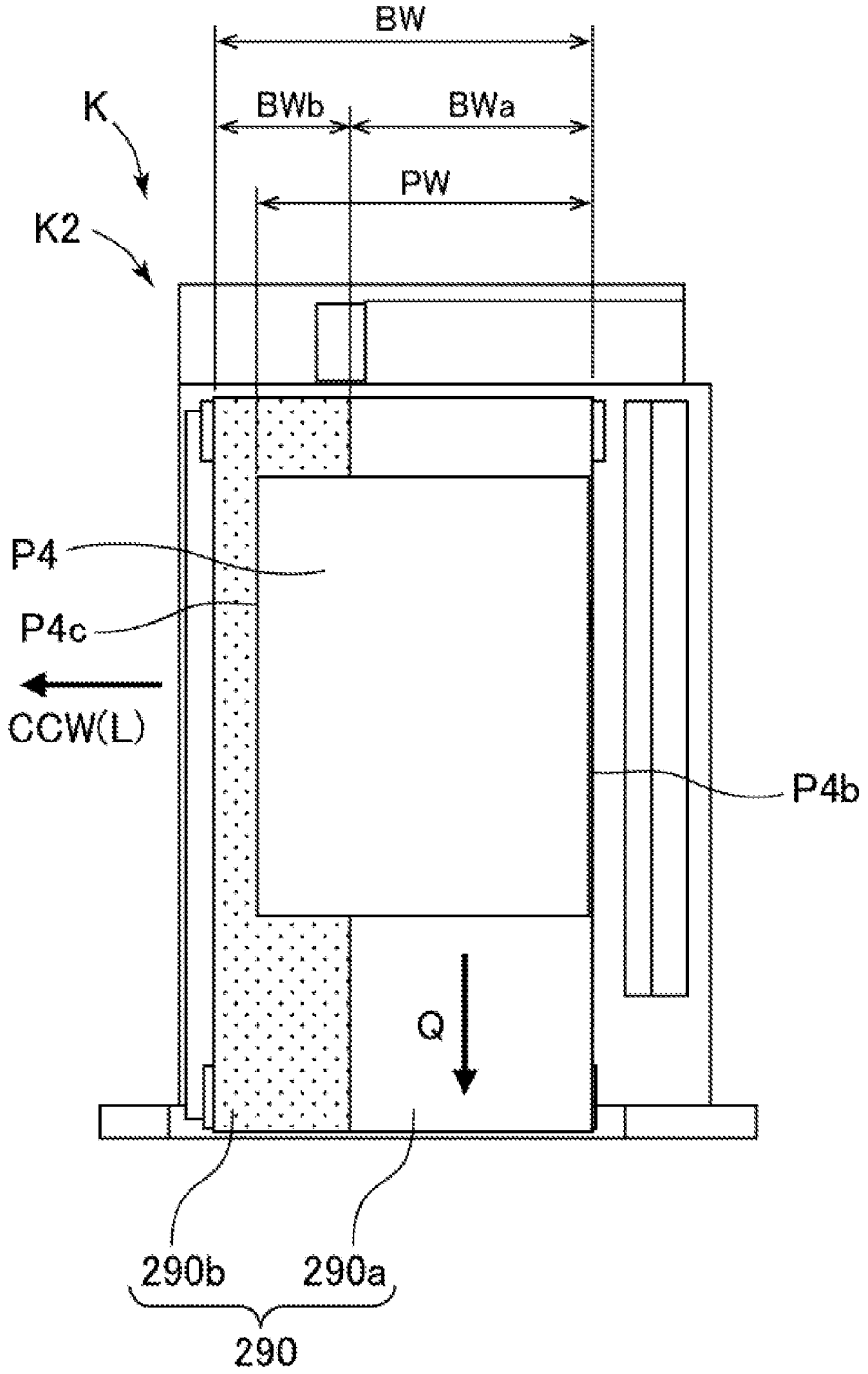
FIG. 22 is a view for illustrating main parts of the sheet bundle discharging apparatus according to another embodiment as seen from a direction perpendicular to a conveyance belt surface.

Also with regard to a conveyance belt (discharging portion) 290 illustrated in FIG. 22, similarly to the sheet bundle discharging portion 90 illustrated in FIG. 21, the booklet P4 having been changed in attitude to the direction of the arrow CCW illustrated in FIG. 20 by at least one of the spine receiver 81 (FIG. 20) and the pressing member 73 is placed. Then, the conveyance belt 290 discharges the placed booklet P4 in the discharging direction (arrow Q direction in FIG. 16 and FIG. 20) perpendicular to the CCW direction.

In the conveyance belt 290, a friction coefficient of a portion 290*b* with which the fore edge P4*c* of the booklet P4 placed on the conveyance belt 290 is brought into contact is set smaller than a friction coefficient of another portion 290*a*. The portion 290*b* with which the fore edge P4*c* is brought into contact is located on the downstream side in the conveyance direction L of the booklet with respect to the another portion 290*a*. Further, a width BWa of the another portion 290*a* of the conveyance belt 290 in the discharging direction Q of the conveyance belt 92 is set so as to be equal to or larger than a half of the width PW (PW/2) of the booklet in the CCW direction for changing the attitude of the booklet and smaller than the width PW of the booklet. The reference symbol BW in FIG. 22 denotes the width of the conveyance belt 290. It is preferred that the width BWa of the another portion 290*a* be set with the maximum width of the various booklet to be subjected to bookbinding as a reference.

Moreover, the reference symbol BWb in FIG. 22 denotes a width of a portion of the conveyance belt 290 having a small friction coefficient.

With the conveyance belt 290 having such a configuration, the fore edge P4*c* of the booklet placed on the conveyance belt 290 is brought into contact with the portion 290*b* of the conveyance belt 92 having a small friction coefficient, thereby being capable of preventing curling of the booklet by allowing the fore edge P4*c* to slip on the portion 290*b* having a small friction coefficient. Further, the width BWa of the another portion 290*a* of the conveyance belt 290 is set so as to be equal to or larger than a half of the width PW of the booklet P4 and smaller than the width PW of the booklet P4, and hence the conveyance belt 290 is held in contact with the booklet at the portion having a large friction coefficient. Therefore, the conveyance belt 290 can convey and discharge the booklet without rotating and inclining the booklet on the conveyance belt 290.

At the time of changing the attitude of the booklet about the spine P4*b* after the spine P4*b*, which is a downstream end portion in the conveyance direction of the booklet having been conveyed, is brought into abutment against the spine receiver 81, such an operation may be performed through only the rotation of the spine receiver 81. In this case, the spine receiver 81 corresponds to the attitude changing unit. Further, after the spine P4*b* is brought into abutment against the spine receiver 81, the attitude of the booklet may be changed through only the movement of the pressing member 73 without rotating the spine receiver 81. In this case, the pressing member 73 corresponds to the attitude changing unit. Further, after the spine P4*b* is brought into abutment against the spine receiver 81, the attitude of the booklet may be changed by the rotating spine receiver 81 and the moving pressing member 73. In this case, the rotating spine receiver 81 and the moving pressing member 73 correspond to the attitude changing unit.

As described above, various configurations may be applied as the configuration for changing the attitude of the booklet to place the booklet on the conveyance belt 92.

(Circulation Start Timing of Conveyance Belt 92)

In the processing of Step S119 to the processing of Step S123, when the booklet P4 is placed on the sheet bundle discharging portion 90 (FIG. 16), the bookbinding apparatus controller 102 (FIG. 17) allows the discharge motor MT to operate, to thereby circulate the conveyance belt 92 in the discharging direction of the booklet (arrow Q direction). The conveyance belt 92 conveys the booklet in the arrow Q direction, to thereby discharge the booklet to the outside of the bookbinding apparatus B on the near side. That is, the booklet is discharged to the front side of a user.

It is required that the conveyance belt 92 be circulated after the booklet is placed on the sheet bundle discharging portion 90, as illustrated in FIG. 12 and FIG. 13. That is, it is required that the conveyance belt 92 perform the discharging operation after the operation of changing the attitude of the booklet by the spine receiver 81. This is because, when the booklet is placed on the circulating conveyance belt 92, skew feed of the booklet is prevented at the moment at which the booklet is brought into abutment against the conveyance belt 92. When the skew feed of the booklet is excessive, there is a risk in that a discharge detecting portion 93 provided on downstream in the discharging direction cannot detect the booklet. Therefore, the circulation start timing of the conveyance belt 92 is set after the placement of the booklet on the conveyance belt 92. The booklet discharge sensor 94S detects whether or not the booklet has been discharged to the outside of the apparatus. When the booklet is discharged to the outside of the apparatus, the bookbinding apparatus controller 102 (FIG. 18) allows the discharge motor MT to rotate forward and allows the pressing member motor MP to reversely rotate, to thereby return the spine receiver 81 to the booklet receiving position (waiting position) and return the pressing member 73 to the waiting position. With this, the series of bookbinding operation by the bookbinding apparatus B is terminated. Next, when the booklet to be conveyed is present, the bookbinding apparatus B repeats the above-mentioned operation to sequentially discharge the booklet to the outside.

When there is employed a configuration in which the conveyance belt 92 and the spine receiver 81 are connected to the discharge motor MT through intermediation of individual clutches, after the booklet is discharged to the outside of the apparatus, the clutch provided between the discharge motor MT and the conveyance belt 92 is turned off, and the clutch provided between the discharge motor MT and the spine receiver 81 is turned on, thereby driving the discharge motor MT to return the spine receiver 81 to the booklet receiving position (waiting position).

Description of the operation of the sheet bundle discharging portion 90 in FIG. 21 in the processing of Step S119 to the processing of Step S123 is similar to the description of the operation of the sheet bundle discharging portion 90 in FIG. 16, and hence is omitted. Moreover, description of the operation of the conveyance belt 290 in FIG. 22 is also similar to the conveyance belt 92 of the sheet bundle discharging portion 90 in FIG. 21, and hence is omitted.

The sheet bundle discharging apparatus according to this embodiment receives the end portion of the sheet bundle with the receiving member having a small friction coefficient at the time of changing the attitude of the sheet bundle, thereby being capable of reducing damage on the sheet bundle and discharging the sheet bundle to the outside of the apparatus.

The bookbinding apparatus according to this embodiment includes the sheet bundle discharging apparatus which is capable of reducing damage on the sheet bundle and discharging the sheet bundle to the outside of the apparatus. Therefore, a sheet bundle with high quality can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-162545, filed Aug. 31, 2018, and Japanese Patent Application No. 2019-138324, filed Jul. 26, 2019, which are hereby incorporated by reference herein in their entirety.

What is claimed is:

1. A sheet bundle discharging apparatus comprising:

a conveyance belt configured to convey and discharge a sheet bundle in a predetermined conveyance direction;

an attitude changing unit configured to change an attitude of the sheet bundle from a first attitude in which the sheet bundle is apart from the conveyance belt to a second attitude in which the sheet bundle is placed on the conveyance belt; and a receiving member configured to receive an end portion of the sheet bundle in a case where the attitude changing unit changes the attitude of the sheet bundle from the first attitude to the second attitude, wherein, by changing the attitude of the sheet bundle from the first attitude to the second attitude by the attitude changing unit, the end portion of the sheet bundle can reach the receiving member after the end portion of the sheet bundle passes through a region above the conveyance belt with a component of movement that is parallel to a conveyance surface of the conveyance belt, the component of movement being in a belt width direction perpendicular to the predetermined conveyance direction, wherein the conveyance belt conveys the sheet bundle in the second attitude in the predetermined conveyance direction, and wherein a friction coefficient between the sheet bundle and the receiving member is smaller than a friction coefficient between the sheet bundle and the conveyance belt.

2. The sheet bundle discharging apparatus according to claim 1, wherein, in the belt width direction, a width of the belt is equal to or larger than ½ times and smaller than 1 time with respect to a maximum width of the sheet bundle to be conveyed by the conveyance belt.

3. The sheet bundle discharging apparatus according to claim 1, wherein the receiving member is formed of a metal plate.

4. The sheet bundle discharging apparatus according to claim 1, wherein the receiving member is located below the conveyance belt at a boundary portion between the receiving member and the conveyance belt when the receiving member is viewed from above.

5. The sheet bundle discharging apparatus according to claim 1, wherein the conveyance belt is supported by and stretched around the receiving member.

6. The sheet bundle discharging apparatus according to claim 1, wherein the attitude changing unit includes a support member configured to support the sheet bundle, and the support member is rotated to change the attitude of the sheet bundle from the first attitude to the second attitude.

7. The sheet bundle discharging apparatus according to claim 6, wherein the support member is configured to support a second end portion which is substantially parallel to the end portion of the sheet bundle.

8. A bookbinding apparatus comprising: a binding unit configured to bind a sheet bundle; and a sheet bundle discharging apparatus including: (1) a conveyance belt configured to convey and discharge a sheet bundle in a predetermined conveyance direction; (2) an attitude changing unit configured to change an attitude of the sheet bundle from a first attitude in which the sheet bundle is apart from the conveyance belt to a second attitude in which the sheet bundle is placed on the conveyance belt; and (3) a receiving member configured to receive an end portion of the sheet bundle in a case where the attitude changing unit changes the attitude of the sheet bundle from the first attitude to the second attitude, wherein, by changing the attitude of the sheet bundle from the first attitude to the second attitude by the attitude changing unit, the end portion of the sheet bundle can reach the receiving member after the end portion of the sheet bundle passes through a region above the conveyance belt with a component of movement that is parallel to a conveyance surface of the conveyance belt, the component of movement being in a belt width direction perpendicular to the predetermined conveyance direction, wherein a friction coefficient between the sheet bundle and the receiving member is smaller than a friction coefficient between the sheet bundle and the conveyance belt, wherein the attitude changing unit changes the attitude of the sheet bundle bound by the binding unit from the first attitude to the second attitude, and wherein the conveyance belt discharges the sheet bundle in the second attitude in the predetermined conveyance direction.

9. The bookbinding apparatus according to claim 8, wherein the binding unit is configured to bind a second end portion which is substantially parallel to the end portion of the sheet bundle.

10. The bookbinding apparatus according to claim 9, wherein the end portion of the sheet bundle comprises a fore edge.

* * * * *